US009620075B2

(12) United States Patent
Kobayashi

(10) Patent No.: US 9,620,075 B2
(45) Date of Patent: Apr. 11, 2017

(54) DISPLAY DRIVER, ELECTRO-OPTICAL DEVICE, AND ELECTRONIC DEVICE

(71) Applicant: SEIKO EPSON CORPORATION, Tokyo (JP)

(72) Inventor: Hironori Kobayashi, Suwa (JP)

(73) Assignee: SEIKO EPSON CORPORATION, Tokyo (JP)

( * ) Notice: Subject to any disclaimer, the term of this patent is extended or adjusted under 35 U.S.C. 154(b) by 29 days.

(21) Appl. No.: 14/658,880

(22) Filed: Mar. 16, 2015

(65) Prior Publication Data

US 2015/0269901 A1 Sep. 24, 2015

(30) Foreign Application Priority Data

Mar. 18, 2014 (JP) ..... 2014-054799

(51) Int. Cl.
*G09G 5/10* (2006.01)
*G09G 3/36* (2006.01)

(52) U.S. Cl.
CPC ..... *G09G 3/3696* (2013.01); *G09G 2320/041* (2013.01); *G09G 2320/0673* (2013.01); *G09G 2330/02* (2013.01)

(58) Field of Classification Search
None
See application file for complete search history.

(56) References Cited

U.S. PATENT DOCUMENTS

2004/0095986 A1 5/2004 Tsuchiya
2006/0092110 A1* 5/2006 Park ..... G09G 3/3648 345/87
2007/0262972 A1* 11/2007 Nakata ..... G09G 3/3696 345/204
2008/0284700 A1* 11/2008 Oke ..... G09G 3/3614 345/89
2008/0284775 A1* 11/2008 Shen ..... G09G 3/3611 345/214

(Continued)

FOREIGN PATENT DOCUMENTS

JP 2004-085384 A 3/2004
JP 2011-232564 A 11/2011

*Primary Examiner* — Seokyun Moon
(74) *Attorney, Agent, or Firm* — Oliff PLC

(57) ABSTRACT

A display driver includes an adjustment unit 20 that outputs an electronic volume value based on a detected temperature derived using a temperature sensor 90, a power supply circuit 60 that supplies a drive power supply voltage based on the electronic volume value, and a drive circuit that drives a display panel based on the drive power supply voltage. The adjustment unit 20 outputs a first electronic volume value that sets the drive power supply voltage to a first voltage, in the case where the detected temperature belongs to a first temperature range, outputs a second electronic volume value that sets the drive power supply voltage to a second voltage, in the case where the detected temperature belongs to a second temperature range, and an interpolated electronic volume value that sets the drive power supply voltage to an interpolated voltage that is between the first voltage and the second voltage, in the case where the temperature range to which the detected temperature belongs switches from the first temperature range to the second temperature range.

17 Claims, 14 Drawing Sheets

(56) References Cited

U.S. PATENT DOCUMENTS

| | | | | |
|---|---|---|---|---|
| 2009/0033685 | A1* | 2/2009 | Park | G09G 3/3233 345/690 |
| 2009/0121994 | A1* | 5/2009 | Miyata | G09G 3/3648 345/89 |
| 2010/0066766 | A1* | 3/2010 | Mancuso | G09G 3/20 345/690 |
| 2013/0083086 | A1* | 4/2013 | Nose | G09G 3/3651 345/690 |

* cited by examiner

DISPLAY DRIVER, ELECTRO-OPTICAL DEVICE, AND ELECTRONIC DEVICE

BACKGROUND

1. Technical Field

The present invention relates to a display driver, an electro-optical device, an electronic device, and the like.

2. Related Art

Display drivers that drive display panels such as LCD panels are conventionally known. Such display drivers are provided with an electronic volume that adjusts the drive power supply voltage of the display panel, and a temperature sensor that detects the environmental temperature. These display drivers adjust an electronic volume value based on the temperature detected by the temperature sensor, and set the drive power supply voltage to a voltage that depends on the environmental temperature.

Taking an LCD panel as an example, the transmittance of liquid crystal changes at different environmental temperatures, and thus even if the LCD panel is driven at the same drive power supply voltage, the hue of the display image will change. Such changes in the hue can be suppressed by setting the drive power supply voltage after adjusting the electronic volume value based on the temperature detected by the temperature sensor. Conventional technologies for such display drivers having an electronic volume and a temperature sensor include the technology disclosed in JP-A-2004-85384, for example.

However, in conventional display drivers, switching of the electronic volume value based on the detected temperature was performed at one time. When switching of the electronic volume value is thus performed at one time, the moment of switching may be visible in the image display. Also, in the case where the temperature is unstable near the boundary at which the electronic volume value is switched, problems such as frequent switching of the electronic volume value, display flicker and the like may arise.

SUMMARY

An advantage of some aspects of the invention is to provide a display driver, an electro-optical device, an electronic device and the like that are able to suppress image quality deterioration, display flicker and the like at the time of switching of electronic volume values.

One aspect of the invention relates to a display driver including an adjustment unit that outputs an electronic volume value based on a detected temperature derived using a temperature sensor, a power supply circuit that supplies a drive power supply voltage based on the electronic volume value, and a drive circuit that drives a display panel based on the drive power supply voltage. The adjustment unit outputs a first electronic volume value that sets the drive power supply voltage to a first voltage, in the case where the detected temperature belongs to a first temperature range, outputs a second electronic volume value that sets the drive power supply voltage to a second voltage, in the case where the detected temperature belongs to a second temperature range, and outputs an interpolated electronic volume value that sets the drive power supply voltage to an interpolated voltage that is between the first voltage and the second voltage, in the case where a temperature range to which the detected temperature belongs switches from the first temperature range to the second temperature range.

According to this aspect of the invention, in the case where the detected temperature derived using the temperature sensor belongs to the first temperature range, the display panel is driven with the drive power supply voltage set to the first voltage, as a result of the electronic volume value being set to the first electronic volume value. Also, in the case where the detected temperature belongs to the second temperature range, the display panel is driven with the drive power supply voltage set to the second voltage, as a result of the electronic volume value being set to the second electronic volume value. Furthermore, when the temperature range to which the detected temperature belongs switches from the first temperature range to the second temperature range, the display panel will be driven with the drive power supply voltage set to an interpolated voltage between the first voltage and the second voltage, as a result of the electronic volume value being set to an interpolated electronic volume value. It is thereby possible to provide a display driver or the like that is able to suppress image quality deterioration, display flicker and the like at the time of switching of electronic volume values.

Also, in the above aspect of the invention, the adjustment unit may output a plurality of interpolated electronic volume values interpolated between the first electronic volume value and the second electronic volume value with a given division number, in the case where the temperature range to which the detected temperature belongs switches from the first temperature range to the second temperature range.

According to this configuration, a plurality of interpolated electronic volume values interpolated between the first electronic volume value and the second electronic volume value with a given division number will be output in the switching period of electronic volume values. This enables the display panel to be driven at a plurality of interpolated drive power supply voltages set with these interpolated electronic volume values, and image quality deterioration, display flicker and the like at the time of switching of electronic volume values to be suppressed even more effectively.

Also, in the above aspect of the invention, the display driver may include a division number register for variably setting the division number.

According to this configuration, the change amount of the electronic volume values in the switching period of electronic volume values can be variably controlled based on the division number that is set in the division number register.

Also, in the above aspect of the invention, the adjustment unit may include a temperature range determination unit that determines the temperature range to which the detected temperature belongs, and an output unit that determines whether the temperature range to which the detected temperature belongs has changed, based on a result of the determination by the temperature range determination unit in the current period and in the last period, and outputs the interpolated electronic volume value that is between the first electronic volume value and the second electronic volume value, if it is determined that the temperature range has changed.

According to this configuration, the pattern of change of the temperature range to which the detected temperature belongs can be appropriately detected, based on the results of the determination by the temperature range determination unit in the current period and in the last period, enabling appropriate interpolated electronic volume values to be output in the switching period of electronic volume values.

Also, in the above aspect of the invention, the adjustment unit may derive the detected temperature, based on a plurality of detected temperature values from the temperature sensor, and determine the temperature range to which the detected temperature belongs.

According to this configuration, an appropriate detected temperature is acquired even in the case where noise or the like is superimposed on the detected temperature value from the temperature sensor, enabling the temperature range to which the detected temperature belongs to be appropriately determined.

Also, in the above aspect of the invention, the relation T1≥T2 may hold, where T1 is a length of a period in which the plurality of detected temperature values are output from the temperature sensor, and T2 is a length of a period in which the interpolated electronic volume value is output.

According to this configuration, the circuitry of the adjustment unit can be simplified, and circuit design can be facilitated.

Also, in the above aspect of the invention, the display driver may include a volume value register for variably setting the first electronic volume value and the second electronic volume value.

According to this configuration, the first electronic volume value that is output in the case where the detected temperature belongs to the first temperature range and the second electronic volume value that is output in the case where the detected temperature belongs to the second temperature range can be variably controlled using the volume value register.

Also, in the above aspect of the invention, the display driver may include a boundary temperature register for variably setting a boundary temperature value of the first temperature range and the second temperature range.

According to this configuration, the boundary temperature value at which switching of temperature ranges occurs can be variably controlled using the boundary temperature register.

Also, in the above aspect of the invention, the display driver may include a volume value register for variably setting the first electronic volume value and the second electronic volume value, a boundary temperature register for variably setting a boundary temperature value of the first temperature range and the second temperature range, and a division number register for variably setting the division number. Also, the adjustment unit may include a temperature range determination unit that determines the temperature range to which the detected temperature belongs, based on the boundary temperature value that is set in the boundary temperature register, an operation unit that outputs a count value signal of a switching period of the electronic volume value and a change amount signal of the electronic volume value in the switching period, based on a result of the determination by the temperature range determination unit in the current period and in the last period, and the division number that is set in the division number register, and an adder that performs addition processing, based on the first electronic volume value and the second electronic volume value that are set in the volume value register, and the count value signal and the change amount signal from the operation unit, and outputs, in the switching period, a plurality of interpolated electronic volume values interpolated between the first electronic volume value and the second electronic volume value with the division number.

According to this configuration, the temperature range to which the detected temperature belongs can be appropriately determined, based on boundary temperature values set in the boundary temperature register. Also, the switching timing and the change amount of the electronic volume values in the switching period of electronic volume values are appropriately set, based on the results of the determination by the temperature range determination unit in the current and last periods and the division number that is set in the division number register, enabling a plurality of appropriate interpolated electronic volume values interpolated between the first electronic volume value and the second electronic volume value with the division number to be output.

Also, in the above aspect of the invention, the power supply circuit may supply a plurality of interpolated voltages obtained by interpolating the first voltage and the second voltage as the drive power supply voltage, in the case where a first detected temperature derived based on a plurality of first detected temperature values that are output from the temperature sensor in a first period belongs to the first temperature range, and a second detected temperature derived based on a plurality of second detected temperature values that are output from the temperature sensor in a second period belongs to the second temperature range.

According to this configuration, the first detected temperature can be derived based on the plurality of first detected temperature values that are output from the temperature sensor in the first period, and the second detected temperature can be derived based on the plurality of second detected temperature values that are output from the temperature sensor in the second period. This enables the display panel to be driven with a plurality of interpolated voltages interpolated between the first voltage and second voltage as the drive power supply voltage, in the case where the first detected temperature and the second detected temperature derived in this way respectively belong to the first temperature range and the second temperature range. The electronic volume values and the drive power supply voltage change gradually in the switching period of electronic volume values, even in the case where the detected temperature fluctuates unstably near the boundary temperature value of the first temperature range and the second temperature range, for example, thereby enabling display flicker and the like to be suppressed.

Another aspect of the invention relates to an electro-optical device including the display driver according to any of the above configurations.

Yet another aspect of the invention relates to an electronic device including the display driver according to any of the above configurations.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, preferred embodiments of the invention will be described in detail. Note that the embodiments that will be described below are not intended to unduly limit the contents of the invention as defined in the claims, and not all of the configurations that will be described in the embodiments are essential to means for solving the problems addressed by the invention.

1. Display Driver, Electro-Optical Device

Figure 1:
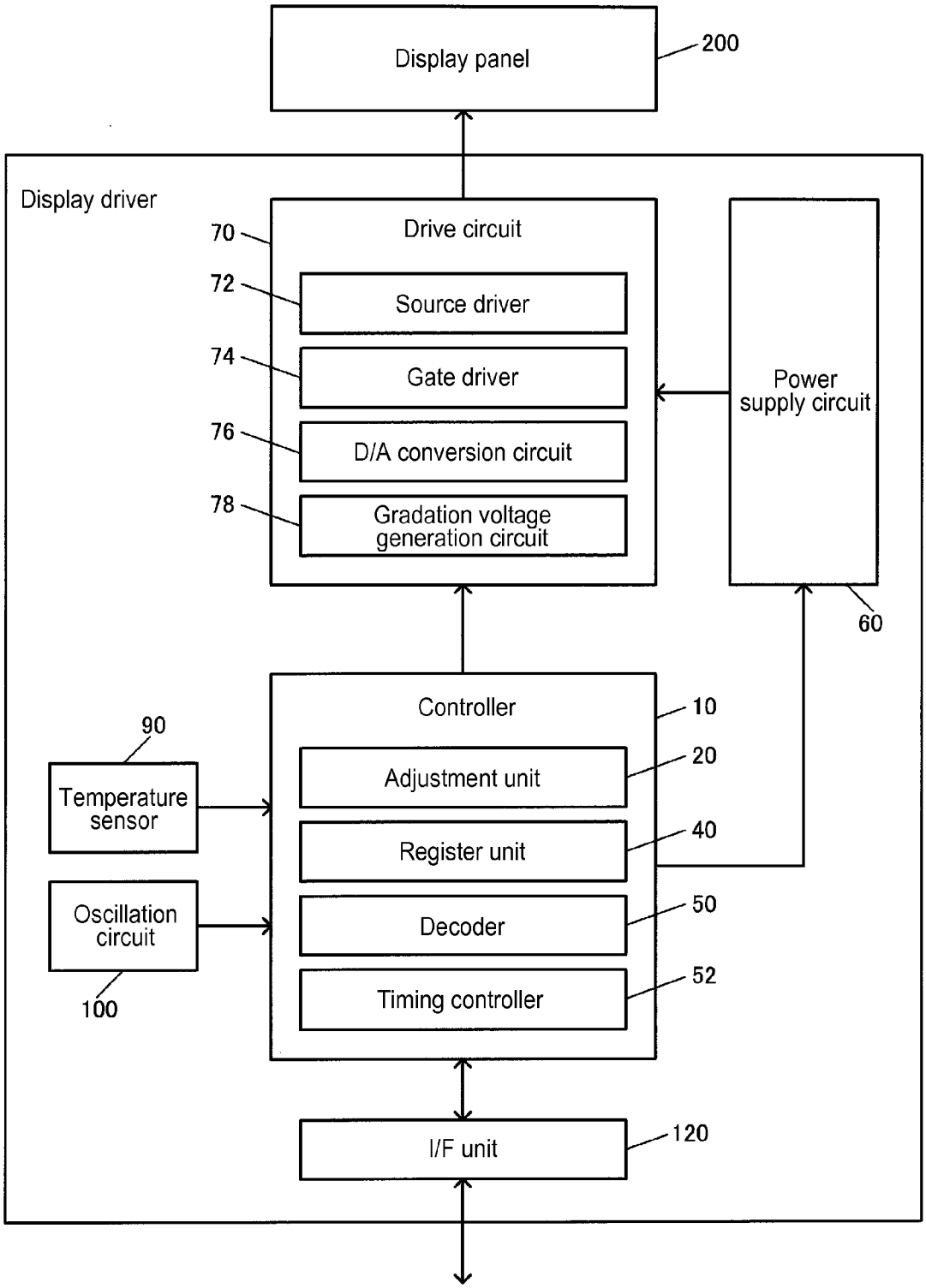
FIG. 1 shows exemplary configurations of a display driver and an electro-optical device of an embodiment.

Exemplary configurations of a display driver of the present embodiment and an electro-optical device that includes this display driver are shown in FIG. 1. The display driver drives a display panel 200, and the display panel 200 displays an image when driven by the display driver. The electro-optical device includes this display driver and the display panel 200 (electro-optical panel). Exemplary electro-optical devices include in-vehicle display units (driver assistance displays, instrument panel displays, car navigation displays, etc.), and display units that are used in handheld terminals, televisions, projectors, and the like.

The display panel 200 is an active matrix LCD panel (liquid crystal panel) that uses switch elements such as thin film transistors (TFTs), for example. The display panel 200 has a plurality of source lines (data lines), a plurality of gate lines (scan lines), and a plurality of pixels. The display panel 200 realizes a display operation by changing the optical characteristics of electro-optical elements (liquid crystal elements, EL elements, etc.) in each pixel region. Note that the display panel 200 may be a panel (EL panel, etc.) other than an LCD panel.

The display driver includes a controller 10, a power supply circuit 60, and a drive circuit 70. Also, the display driver can include a temperature sensor 90, an oscillation circuit 100, and an interface (I/F) unit 120. Note that the display driver of the present embodiment is not limited to the configuration shown in FIG. 1, and can be variously modified by omitting or adding constituent elements, or the like.

The controller 10 performs various types of control processing. For example, the controller 10 controls the various units of the display driver, controls the display timing, and controls data processing. This controller 10 can be realized by a processor, a logic circuit such as a gate array circuit, or the like.

The controller 10 includes an adjustment unit 20, a register unit 40, a decoding unit 50, and a timing controller 52. The adjustment unit 20 will be discussed in detail later. The register unit 40 has a register for storing various types of information, and is realized by a memory such as a flip-flop circuit or RAM, for example. The decoding unit 50 decodes commands input from external devices (MPU, display controller, etc.) via the I/F unit 120, for example. Various types of information acquired through the decoding are stored by the register unit 40. The timing controller 52 generates various types of display control signals for controlling the display operation of the display panel 200.

The power supply circuit 60 generates and supplies a power supply voltage. For example, the power supply circuit 60 has a booster circuit and a regulator, and supplies a power supply voltage generated by the booster circuit and the regulator to the various units of the display driver. For example, the power supply circuit 60 generates a drive power supply voltage and supplies the drive power supply voltage to the drive circuit 70. Also, the power supply circuit 60 generates a power supply for the internal logic circuit, and supplies power to the controller 10. The power supply circuit 60 also generates a reference power supply voltage, etc.

The drive circuit 70 drives the display panel 200. Specifically, the source lines and the like of the display panel 200 are driven based on the drive power supply voltage supplied from the power supply circuit 60. This drive circuit 70 has a source driver 72, a gate driver 74, a D/A conversion circuit 76, and a gradation voltage generation circuit 78, for example. Note that the drive circuit 70 can be modified to not include the gate driver 74 or the like.

The source driver 72 drives the source lines of the display panel 200. For example, the source driver 72 drives the source lines (data lines) by supplying a source voltage (data voltage) that is based on image data (display data). The gate driver 74 drives the gate lines of the display panel 200. For example, the gate driver 74 drives the gate lines (scan lines) by supplying a selection voltage for sequentially selecting the gate lines. The gradation voltage generation circuit 78 (gamma circuit) generates a plurality of gradation voltages (e.g., 256 gradations). The D/A conversion circuit 76 selects a voltage from the plurality of gradation voltages generated by the gradation voltage generation circuit 78, based on the image data from the controller 10, and supplies the selected voltage to the source driver 72 as a source voltage.

The temperature sensor 90 performs temperature detection. For example, the temperature sensor 90 outputs a detected temperature value that corresponds to the detected temperature (environmental temperature). For example, a temperature detector circuit of the temperature sensor 90 outputs an analog detected temperature voltage having a gradient with respect to temperature, and an A/D conversion circuit of the temperature sensor 90 performs A/D conversion on the analog detected temperature voltage to obtain a digital detected temperature value and outputs the digital detected temperature value to the controller 10.

The oscillation circuit 100 generates an oscillation clock signal by performing an oscillation operation. The controller 10 and the like operate using a clock signal that is based on this oscillation clock signal. The oscillation circuit 100 can be realized by a CR oscillation circuit or the like having a resistor and a capacitor, for example.

The I/F unit 120 performs interface processing with external devices (MPU, display controller, etc.). This I/F unit 120 includes a MPU interface circuit (host interface circuit) and a RGB interface circuit, for example.

2. Automatic Adjustment of Electronic Volume Value

In a conventional display driver, switching of the electronic volume value based on the detected temperature of the temperature sensor is performed at one time. This may lead to problems such as the moment at which the electronic volume value is switched being visible in the image display or the display flickering when the electronic volume value is switched frequently in the case where the detected temperature is unstable near the boundary of the switching.

In order to resolve such problems, in the present embodiment, a technique of dividing up and outputting the electronic volume value gradually is employed, rather than switching the electronic volume value at one time. For example, a technique that involves changing the electronic volume value gradually is employed when the temperature range to which the detected temperature belongs changes.

In order to realize such a technique, the display driver of the present embodiment includes the adjustment unit 20 that outputs an electronic volume value based on a detected temperature derived using the temperature sensor 90, the power supply circuit 60 that supplies a drive power supply voltage based on the electronic volume value, and the drive circuit 70 that drives the display panel 200 based on the drive power supply voltage.

The adjustment unit 20 outputs a first electronic volume value that sets the drive power supply voltage to a first voltage, in the case where the detected temperature belongs to a first temperature range. On the other hand, the adjustment unit 20 outputs a second electronic volume value that sets the drive power supply voltage to the second voltage, in the case where the detected temperature belongs to a second temperature range. For example, the first temperature range and the second temperature range are adjacent temperature ranges having a boundary temperature value as the boundary therebetween. The adjustment unit 20 outputs an interpolated electronic volume value that sets the drive power supply voltage to an interpolated voltage that is between the first voltage and the second voltage, in the case where the temperature range to which the detected temperature belongs switches from the first temperature range to the second temperature range. Note that the adjustment unit 20 also outputs an interpolated electronic volume value that sets the drive power supply voltage to an interpolated voltage that is between the first voltage and the second voltage, in the case where the temperature range to which the detected temperature belongs switches from the second temperature range to the first temperature range.

Specifically, the adjustment unit 20 outputs a plurality of interpolated electronic volume values interpolated between the first electronic volume value and the second electronic volume value with a given division number, in the case where the temperature range (temperature region) to which the detected temperature belongs switches from the first temperature range to the second temperature range. For example, the adjustment unit outputs values that gradually change from the first electronic volume value to the second electronic volume value as interpolated electronic volume values in the switching period of electronic volume values, in the case where the temperature range of the detected temperature switches. The power supply circuit 60 outputs the interpolated voltages that gradually change from the first voltage (first drive power supply voltage) to the second voltage (second drive power supply voltage) as drive power supply voltages in this switching period. Note that the adjustment unit 20 outputs values that gradually change from the second electronic volume value to the first electronic volume value as interpolated electronic volume values in the switching period of electronic volume values, in the case where the temperature range to which the detected temperature belongs switches from the second temperature range to the first temperature range. The power supply circuit 60 then outputs interpolated voltages that gradually change from the second voltage to the first voltage as the drive power supply voltage in this switching period.

Here, the relation PWV1<PWVIP<PWV2 (or PWV1>PWVIP>PWV2), for example, holds, where PWV1 is the first voltage, PWV2 is the second voltage, and PWVIP is the interpolated voltage. Also, the relation EV1<EVIP<EV2 (or EV1>EVIP>EV2) holds, where EV1 is the first electronic volume value, EV2 is the second electronic volume value, and EVIP is the interpolated electronic volume value. Also, the drive power supply voltage is the power supply voltage that is used by the drive circuit 70 for driving the display panel 200. Exemplary drive power supply voltages include a common electrode drive voltage (VCOM), a power supply voltage for a source driver, a power supply voltage for a gate driver, and a power supply voltage for a gradation voltage generation circuit.

With the display driver of the present embodiment having such a configuration, the moment of switching is not readily visible in the image display, since the electronic volume value changes gradually when the temperature range to which the detected temperature belongs switches, enabling an improvement in image quality to be realized. Also, it is possible to sufficiently suppress display flicker, even in the case where the detected temperature is unstable near the boundary of the switching of electronic volume values.

Figure 2:
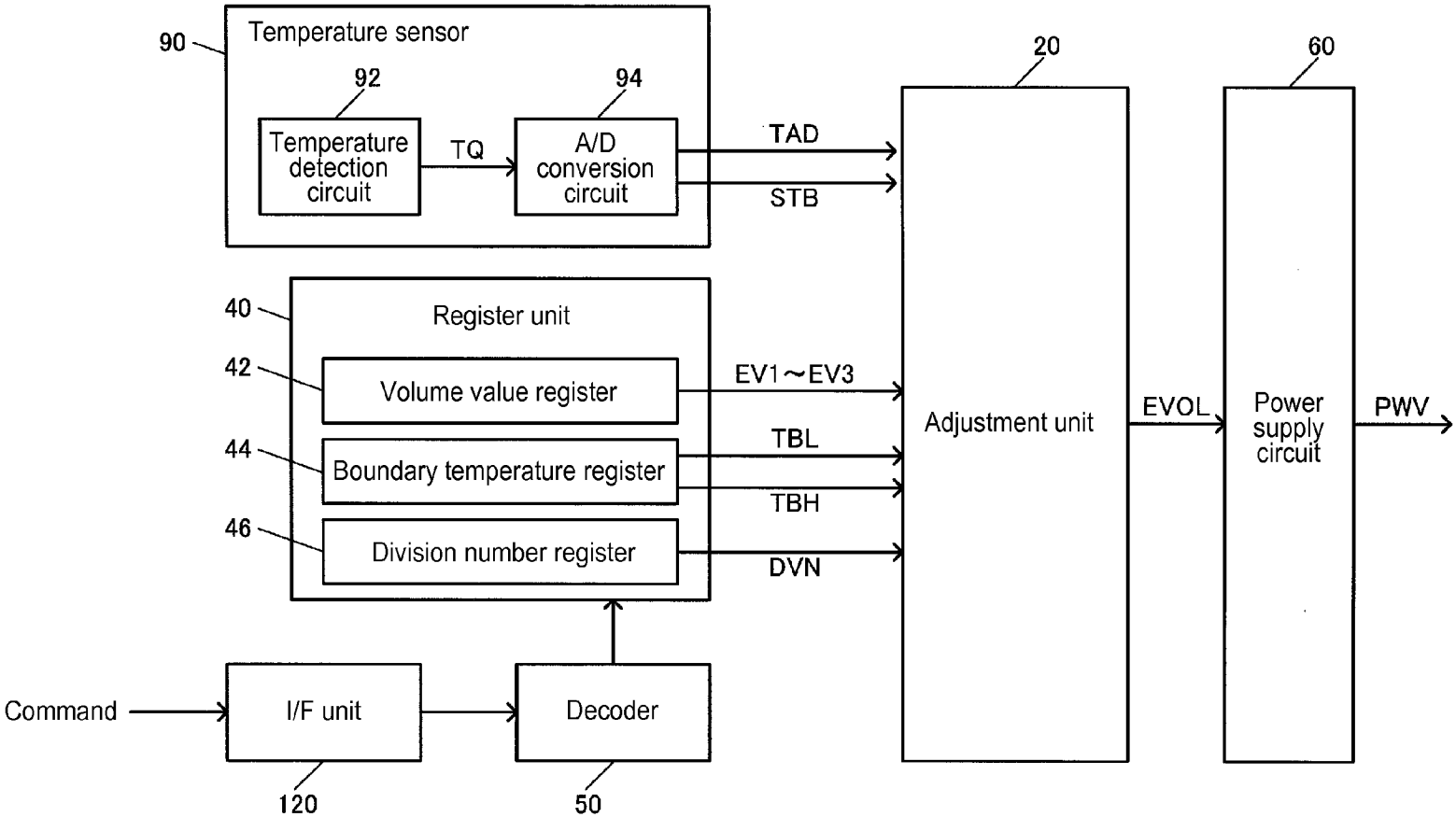
FIG. 2 shows a main portion of the display driver of the embodiment.

FIG. 2 shows a main portion of the display driver of the present embodiment. The temperature sensor 90 has a temperature detector circuit 92 and an A/D conversion circuit 94. The temperature detector circuit 92 outputs an analog detected temperature voltage TQ. This detected temperature voltage TQ is an analog voltage having a gradient with respect to temperature. The A/D conversion of the analog detected temperature voltage TQ from the temperature detector circuit 92 is performed by the A/D conversion circuit 94. The temperature sensor 90 thereby outputs a detected temperature value TAD which is a digital value. Also, the temperature sensor 90 outputs a strobe signal STB.

Note that the temperature sensor 90 can conceivably be realized through various configurations. For example, the temperature detector circuit 92 of the temperature sensor 90 can be realized by a reference voltage generation circuit that generates a reference voltage having a gradient with respect to temperature, a fuse circuit that has a ladder resistor and generates a division voltage from the reference voltage, a voltage generation circuit that generates an analog detected temperature voltage based on the division voltage, and the like. Also, the temperature sensor 90 may be realized using a temperature detection element such as a thermistor.

The I/F unit 120 accepts commands issued from external devices (MPU, display controller, etc.). The decoding unit 50 decodes accepted commands and writes decoding results to the register unit 40.

The register unit 40 has a volume value register 42, a boundary temperature register 44, and a division number register 46.

The volume value register 42 stores electronic volume values associated with each temperature range. The boundary temperature register 44 stores boundary temperature values of the temperature ranges.

For example, as described above, the adjustment unit 20 outputs a first electronic volume value that sets the drive power supply voltage to a first voltage, in the case where the detected temperature belongs to the first temperature range, and outputs a second electronic volume value that sets the drive power supply voltage to a second voltage, in the case where the detected temperature belongs to the second temperature range. In this case, the first electronic volume value is an electronic volume value that is set in association with the first temperature range, and the second electronic volume value is an electronic volume value that is set in association with the second temperature range.

The volume value register 42 is a register for variably setting these first and second electronic volume values. For example, an external device issues a command for setting the first and second electronic volume values, and the decoding unit 50 decodes this command. The first and second electronic volume values obtained as a result of the decoding are written to the volume value register 42.

Also, the boundary temperature register 44 is a register for variably setting the boundary temperature value of the first temperature range and the second temperature range. For example, an external device issues a command for setting the boundary temperature value of the temperature range, and the decoding unit 50 decodes this command. The boundary temperature value obtained as a result of the decoding is then written to the boundary temperature register 44.

Also, as described above, the adjustment unit 20 outputs a plurality of interpolated electronic volume values interpolated between the first electronic volume value and the second electronic volume value with a given division number (number of divisions). In this case, the division number register 46 is a register for variably setting the division number to be used at the time of performing this interpolation. For example, an external device issues a command for setting the division number of interpolation of electronic volume values, and the decoding unit 50 decodes this command. The division number obtained as a result of the decoding is then written to the division number register 46.

The adjustment unit 20 receives the detected temperature value TAD and the strobe signal STB from the temperature sensor 90. Also, first to third electronic volume values EV1 to EV3 associated with first to third temperature ranges are read out from the volume value register 42. Also, a boundary temperature value TBL of the first temperature range and the second temperature range and a boundary temperature value TBH of the second temperature range and the third temperature range are read out from the boundary temperature register 44. Also, a division number DVN of interpolation of electronic volume values is read out from the division number register 46.

The adjustment unit 20 outputs a plurality of electronic volume values EVOL interpolated between the first electronic volume value EV1 and the second electronic volume value EV2 with the division number DVN, in the case where the temperature range to which the detected temperature derived with the detected temperature value TAD belongs switches from the first temperature range to the second temperature range. The adjustment unit 20 also outputs a plurality of electronic volume values EVOL interpolated between the first electronic volume value EV1 and the second electronic volume value EV2 with the division number DVN, in the case where the temperature range to which the detected temperature belongs switches from the second temperature range to the first temperature range.

Also, the adjustment unit 20 outputs a plurality of electronic volume values EVOL interpolated between the second electronic volume value EV2 and the third electronic volume value EV3 with the division number DVN, in the case where the temperature range to which the detected temperature belongs switches from the second temperature range to the third temperature range. The adjustment unit also outputs a plurality of electronic volume values EVOL interpolated between the second electronic volume value EV2 and the third electronic volume value EV3 with the division number DVN, in the case where the temperature range to which the detected temperature belongs switches from the third temperature range to the second temperature range.

The power supply circuit 60 receives the electronic volume values EVOL from the adjustment unit 20. The power supply circuit 60 sets the drive power supply voltage PWV to voltages corresponding to the electronic volume values EVOL, and outputs the voltages to the drive circuit 70.

Figure 3:
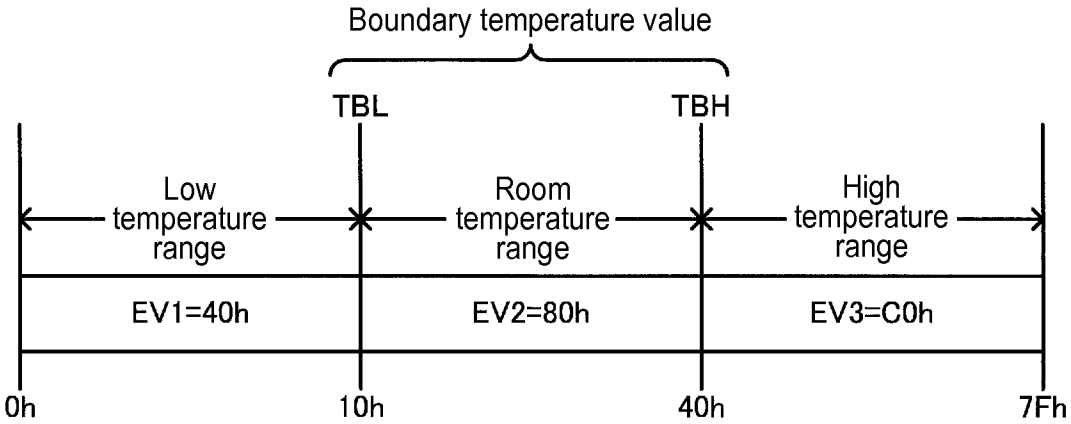
FIG. 3 illustrates temperature ranges and electronic volume values that are set in each temperature range.

FIG. 3 shows examples of the first to third electronic volume values EV1 to EV3 that are set in the first to third temperature ranges and the boundary temperature values TBL and TBH of the temperature ranges.

In FIG. 3, the first, second and third temperature ranges are respectively a low temperature range, a room temperature range, and a high temperature range. The electronic volume value EV1 is set to 40h in the low temperature range, the electronic volume value EV2 is set to 80h in the room temperature range, and electronic volume value EV3 is set to C0h in the high temperature range. These electronic volume values EV1 to EV3 are set in the volume value register 42. Also, the boundary temperature value TBL of the low temperature range and the room temperature range is set to 10h, and the boundary temperature value TBH of the room temperature range and the high temperature range is set to 40h. These boundary temperature values TBL and TBH are set in the boundary temperature register 44. In the present embodiment, appropriate operation of the display driver over a wide temperature range, such as −40° C. to 120° C., for example, is realized by thus setting the low temperature range, the room temperature range and the high temperature range and the electronic volume values EV1, EV2 and EV3 corresponding thereto. Note that although FIG. 3 illustrates the case where three temperature ranges are set, two temperature ranges or four or more temperature ranges may be set.

Figure 4:
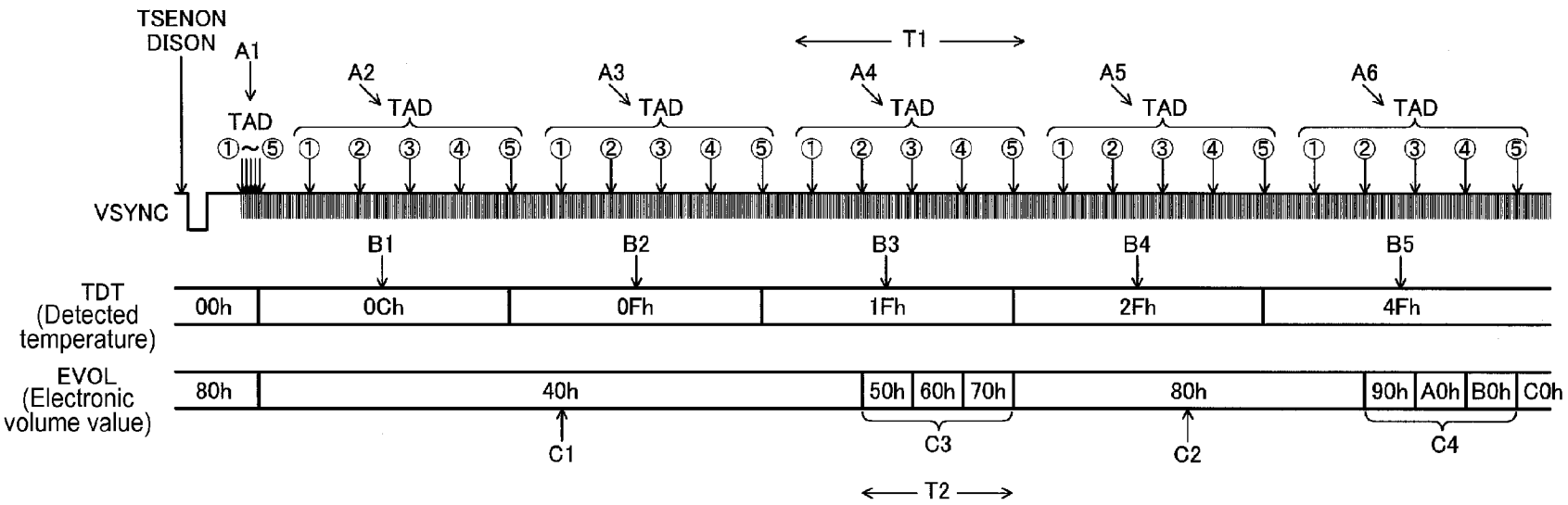
FIG. 4 is a timing chart illustrating operations of the embodiment.

FIG. 4 is a timing chart illustrating the operation of the present embodiment in detail.

First a command TSENON that turns on operation of the temperature sensor 90 and a command DISON that turns on display of the display panel 200 are issued by an external device, for example. A synchronization signal VSYNC is thereby activated every frame, and the display operation of the display panel 200 starts. Also, operation of the temperature sensor 90 is turned on, and the detected temperature value TAD is output from the temperature sensor 90.

As shown in A1 of FIG. 4, the detected temperature value TAD from the temperature sensor 90 is sampled and measured every frame (VSYNC) the first time. Also, as shown in A2 to A6, the detected temperature value TAD is sampled and measured once every 64 frames (approx. 1 sec) from the second time onward. Here, A2 (and A3 to A6) is the detection period of a detected temperature TDT which will be discussed later, and, in the present embodiment, other operation periods, timings and the like are set based on A2.

In the present embodiment, the detected temperature TDT is derived, based on a plurality of detected temperature values TAD of the temperature sensor 90, and the temperature range to which the detected temperature TDT belongs is determined. For example, in FIG. 4, the detected temperature TDT is derived based on the five detected temperature values TAD. Specifically, the median of the five detected temperature values TAD is calculated as the detected temperature TDT.

For example, the detected temperature TDT shown in B1 of FIG. 4 is derived as 0Ch, based on the five detected temperature values TAD sampled as shown in A1. This detected temperature TDT=0Ch is the median of the five detected temperature values TAD shown in A1. Also, the detected temperature TDT=0Fh derived as shown in B2, based on the five detected temperature values TAD shown in A2. This detected temperature TDT=0Fh is the median of the five detected temperature values TAD shown in A2. Similarly, the detected temperatures TDT=1Fh, 2Fh and 4Fh are derived as shown in B3, B4 and B5, based on the five detected temperature values TAD shown in A3, A4 and A5. By deriving the median of a plurality of detected temperature values TAD as the detected temperature TDT in this way, a situation where the temperature is incorrectly detected due to noise or the like being superimposed on the detected temperature value TAD can be suppressed. Note that the detected temperature TDT may be derived by performing processing such as averaging the plurality of detected temperature values TAD.

The relation 0h<0Ch<10h holds for the detected temperature TDT=0Ch derived in B1 of FIG. 4. Accordingly, it is determined that this detected temperature TDT=0Ch belongs in the low temperature range of FIG. 3 (broadly, the first temperature range). The relation 0h<0Fh<10h also holds for the detected temperature TDT=0Fh shown in B2. Accordingly, it is determined that this detected temperature TDT=0Fh also belongs in the low temperature range.

The electronic volume value EV1=40h is set with respect to the low temperature range, as shown in FIG. 3. Accordingly, in the case where the detected temperature TDT belongs in the low temperature range, the adjustment unit 20 outputs the electronic volume value EVOL=EV1=40h, as shown in C1.

On the other hand, the relation 10h<1Fh<40h holds for the detected temperature TDT=1Fh shown in B3. Accordingly, it is determined that this detected temperature TDT=1Fh belongs to the room temperature range of FIG. 3 (broadly, the second temperature range). The relation 10h<2Fh<40h also holds for the detected temperature TDT=2Fh shown in B4. Accordingly, it is determined that this detected temperature TDT=2Fh also belongs to the room temperature range.

The electronic volume value EV2=80h is set with respect to the room temperature range, as shown in FIG. 3. Accordingly, the adjustment unit 20 outputs the electronic volume value EVOL=EV2=80h as shown in C2, in the case where the detected temperature TDT belongs to the room temperature range.

Thus, in the present embodiment, in the case where the detected temperature TDT belongs in the low temperature range (first temperature range), the adjustment unit 20 outputs the electronic volume value EV1=40h (first electronic volume value) associated with the low temperature range as the electronic volume value EVOL. On the other hand, in the case where the detected temperature TDT belongs to the room temperature range (second temperature range), the adjustment unit 20 outputs the electronic volume value EV2=80h (second electronic volume value) associated with the room temperature range as the electronic volume value EVOL.

In B2 and B3 of FIG. 4, the temperature range to which the detected temperature TDT belongs switches from the low temperature range (first temperature range) to the room temperature range (second temperature range). In this case, in the present embodiment, the adjustment unit 20 outputs interpolated electronic volume values EVOL=50h, 60h and 70h, as shown in C3. That is, the plurality of interpolated electronic volume values EVOL=50h, 60h and 70h obtained by interpolating the electronic volume value EVOL=EV1=40h and the electronic volume value EVOL=EV2=80h with the division number DVN=4 set in the division number register 46 of FIG. 2 are output. That is, interpolated electronic volume values obtained by dividing up the difference between the electronic volume values EVOL=EV1 and EVOL=EV2 into portions equal in number to the division number DVN are output. In the present embodiment, the timing at which the interpolated electronic volume values are output is adjusted to the sampling timing of the detected temperature values TAD.

Also, in B4 and B5 of FIG. 4, the temperature range to which the detected temperature TDT belongs switches from the room temperature range to the high temperature range. In this case, the adjustment unit 20 outputs interpolated electronic volume values EVOL=90h, A0h and B0h, as shown in C4. That is, the plurality of interpolated electronic volume values EVOL=90h, A0h and B0h obtained by interpolating the electronic volume values EVOL=EV2=80h and the electronic volume values EVOL=EV3=C0h with the division number DVN=4 are output. That is, interpolated electronic volume values obtained by dividing up the difference between the electronic volume values EVOL=EV2 and EVOL=EV3 into portions equal in number to the division number DVN are output.

According to the present embodiment as described above, while the detected temperature remains within each temperature range (low temperature range, room temperature range, high temperature range), the electronic volume value EVOL does not change from the electronic volume value (EV1 to EV3) set in each temperature range, and the drive power supply voltage also does not change. Accordingly, a situation where the hue or the like of image display changes unnecessarily because of the drive power supply voltage changing due to an unnecessary change in the electronic volume value EVOL can be suppressed. Stable image display by the display panel 200 can thereby be realized.

Also, in the case where such temperature ranges are set, the drive power supply voltage changes greatly due to the electronic volume value EVOL changing greatly when switching of temperature ranges occurs, possibly resulting in the moment of switching being visible in the image display. For example, in FIG. 3, the electronic volume value EV1=40h is set with respect to the low temperature range, and the electronic volume value EV2=80h is set with respect to the room temperature range, and thus there is large difference between EV1 and EV2. Accordingly, the electronic volume value changes greatly, such as from 40h to 80h, at the moment of switching from the low temperature range to the room temperature range, and when the drive power supply voltage also changes greatly accordingly, this change could possibly be visible in the image display.

With regard to this point, in the present embodiment, the electronic volume value EVOL changes gradually in the switching period of temperature ranges, as shown in C3 and C4 of FIG. 4. For example, when switching from the low temperature range to the room temperature range, the electronic volume value EVOL changes gradually, such as from 40h to 50h, 60h, 70h and 80h, as shown in C3. Also, when switching from the room temperature range to the high temperature range, the electronic volume value EVOL changes gradually, such as from 80h to 90h, A0h, B0h and C0h, as shown in C4. Accordingly, the drive power supply voltage will also change gradually, enabling a situation where the moment of switching is visible in the image display to be suppressed.

Also, for example, in the case where the detected temperature changes unstably near the boundary temperature (TBL and TBH in FIG. 3) between temperature ranges, the electronic volume value EVOL is switched frequently, possibility causing flicker to occur in the image display.

With regard to this point, in the present embodiment, the electronic volume value changes gradually near the boundary of the temperature ranges, as shown in C3 and C4 of FIG. 4. Accordingly, display flicker can be adequately suppressed, even in the case where the detected temperature changes unstably near the boundary temperature of the temperature ranges, as will be described in detail later with FIGS. 13A and 13B.

Note that as a exemplary comparative technique of the present embodiment, it is conceivable to compute the voltage difference between the drive power supply voltage and an optimum voltage set using the detected temperature, set the amount of change in the drive power supply voltage based on this voltage difference, such that the time taken for the drive power supply voltage to reach the optimum voltage is a predetermined period of time, and approximate the drive power supply voltage to the optimum voltage.

However, this exemplary comparative technique is directed to preventing a situation where the drive power supply voltage takes a long time to converge to the optimum voltage due to repeatedly overshooting and undershooting the optimum voltage. In contrast, the technique of the present embodiment is for suppressing display flicker and the like in the case where the detected temperature changes unstably near the boundary temperature, and is directed to solving different problems from the exemplary comparative technique.

Also, in the present embodiment, the electronic volume values EV1 to EV3 that are set for each temperature range, the boundary temperature values TBL and TBH of the temperature ranges, and the division number DVN that is used when interpolating electronic volume values are set in respective registers. Accordingly, the electronic volume values EV1 to EV3, the boundary temperature values TBL and TBH, and the division number DVN can be variably set according to user specifications or the like. As a result, the demands of various users can be accommodated, enabling improvements in user convenience and the like.

Also, in the present embodiment, the detected temperature TDT is derived, based on a plurality of detected temperature values TAD from the temperature sensor 90, and the temperature range to which this detected temperature TDT belongs is determined. Accordingly, a situation where an incorrect detected temperature TDT is measured due to noise or the like superimposed on the detected temperature value TAD, causing the electronic volume value to change unexpectedly and the display panel 200 to be driven with a drive power supply voltage that is not normal can be suppressed. For example, by deriving the median of a plurality of detected temperature values as the detected temperature, an abnormal value produced by noise or the like will not be reflected in the detected temperature, even in the case where this abnormal value exists among the plurality of detected temperature values from the temperature sensor 90. Accordingly, even in the case where an abnormal value is output as the detected temperature value of the temperature sensor 90, a situation where this abnormal value adversely affects the display of the display panel 200 can be effectively suppressed.

Also, in FIG. 4, the length of the period in which a plurality of detected temperature values TAD are output from the temperature sensor 90 is given as T1, and the length of the period in which interpolated electronic volume values are output is given as T2. For example, T1 is the length of the period in which five detected temperature values are output from the temperature sensor 90 and sampled, as shown in A4 of FIG. 4. Also, T2 is the length of the period in which the interpolated electronic volume values 50h, 60h and 70h are output, and is the length of the switching period of electronic volume values, as shown in C3. In this case, in the present embodiment, the relation T1≥T2 holds, for example. The relation T1>T2 holds in A4 and C3 of FIG. 4, for example.

According to this configuration, the switching period of electronic volume values (T2) can be accommodated within the sampling period of detected temperature values (T1). Accordingly, a situation where the switching period becomes longer and extends into the next sampling period of detected temperature values can be prevented. Since it is thereby not necessary to take into account a situation where the switching period extends into the next sampling period, the circuitry of the adjustment unit 20 can be simplified, and circuit design can be facilitated.

Note that, in the present embodiment, the relation T1>T2 is set so as to hold using the division number DVN=4. This depends on a number smaller than five, which is the number of samples of the detected temperature value TAD in the detection period (i.e., A2 of FIG. 4) of the detected temperature TDT being set as the division number DVN.

3. Detailed Exemplary Configuration

Figure 5:
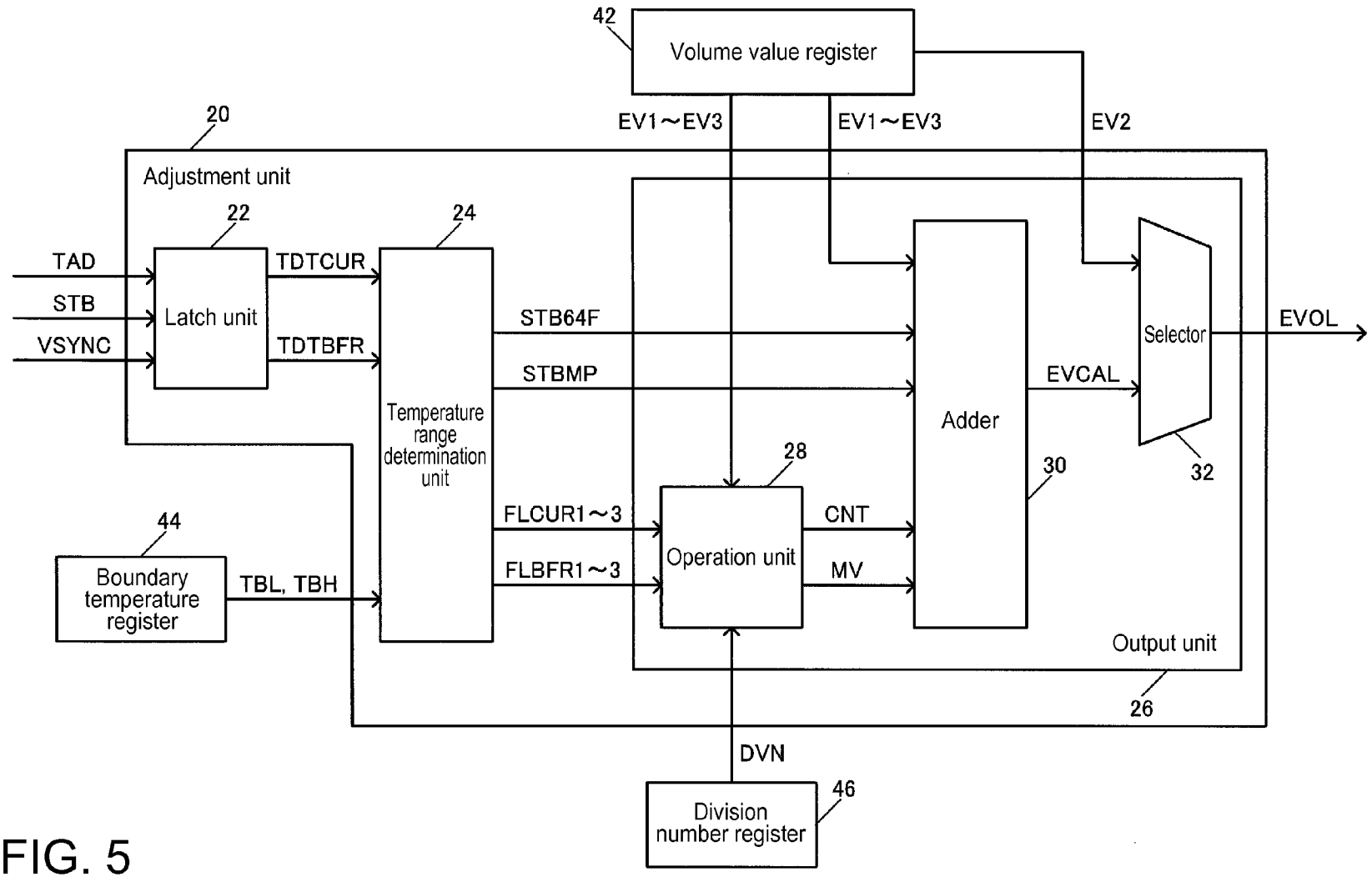
FIG. 5 shows an exemplary configuration of an adjustment unit.

Next, a detailed exemplary configuration and operations of the present embodiment will be described. FIG. 5 shows a detailed exemplary configuration of the adjustment unit 20. Note that the adjustment unit 20 of the present embodiment is not limited to the configuration of FIG. 5, and various modifications such as omitting some of the constituent elements or adding other constituent elements are possible.

The adjustment unit 20 includes a temperature range determination unit 24 and an output unit 26. Also, the adjustment unit 20 can include a latch unit 22.

The latch unit 22 receives the strobe signal STB and the synchronization signal VSYNC. The detected temperature value TAD from the temperature sensor 90 is latched by a latch signal that is based on these signals. The latch unit 22 outputs a signal TDTCUR showing the current detected temperature (current sampling period) and a signal TDTBFR showing the previous detected temperature (previous sampling period) to the temperature range determination unit 24.

The temperature range determination unit 24 determines the temperature range to which the detected temperature belongs. The output unit 26 then determines whether the temperature range to which the detected temperature belongs has changed, based on the results of the determination by the temperature range determination unit 24 in the last period and in the current period. For example, the output unit 26 determined whether the temperature range to which the detected temperature belongs has changed, by performing processing such as comparing the determination result in the last period with the determination result in the current period. The output unit 26 then outputs interpolated electronic volume values between the first electronic volume value and the second electronic volume value, in the case where it is determined that the temperature range to which the detected temperature belongs has changed. That is, the output unit outputs interpolated electronic volume values such as shown in C3 and C4 of FIG. 4 in the switching period of temperature ranges (electronic volume values).

Specifically, the temperature range determination unit 24 receives the detected temperature signals TDTCUR and TDTBFR from the latch unit 22. Also, the temperature range determination unit 24 receives the boundary temperature values TBL and TBH from the boundary register 44. The temperature range determination unit 24 performs processing such as determining the temperature range to which the detected temperature belongs, and outputs strobe signals STB64F and STBMP to the output unit 26 (adder 30). Here, the strobe signal STB64F is activated once every 64 frames (approx. 1 sec). Also, the temperature range determination unit 24 outputs flag signals FLCUR1 to FLCUR3 showing the temperature range to which the current detected temperature belongs, and flag signals FLBFR1 to FLBFR3 showing the temperature range to which the previous detected temperature belongs to the output unit 26 (operation unit 28).

The output unit 26 includes an operation unit 28, an adder 30, and a selector 32. The operation unit 28 receives the flag signals FLCUR1 to FLCUR3 and FLBFR1 to FLBFR3 of the temperature ranges from the temperature range determination unit 24. Also, the operation unit 28 receives the division number DVN from the division number register 46 and the electronic volume values EV1 to EV3 from the volume value register 42. The operation unit 28 then performs operation processing based on these signals and register values, and outputs a count value signal CNT for the switching period of electronic volume values, and a change amount signal MV of the electronic volume values in the switching period to the adder 30.

The adder 30 receives the electronic volume values EV1 to EV3 respectively set for temperature ranges from the volume value register 42. Also, the adder 30 receives the strobe signals STB64F and STBMP from the temperature range determination unit 24, and receives the count value signal CNT and the change amount signal MV from the operation unit 28. The adder 30 then performs processing for adding a change value that is specified using the count value signal CNT and the change amount signal MV to the electronic volume values EV1 to EV3 respectively set for temperature ranges, the switching period of electronic volume values. The adder 30 then outputs the electronic volume value EVCAL derived by the addition processing to the selector 32.

Figure 11:
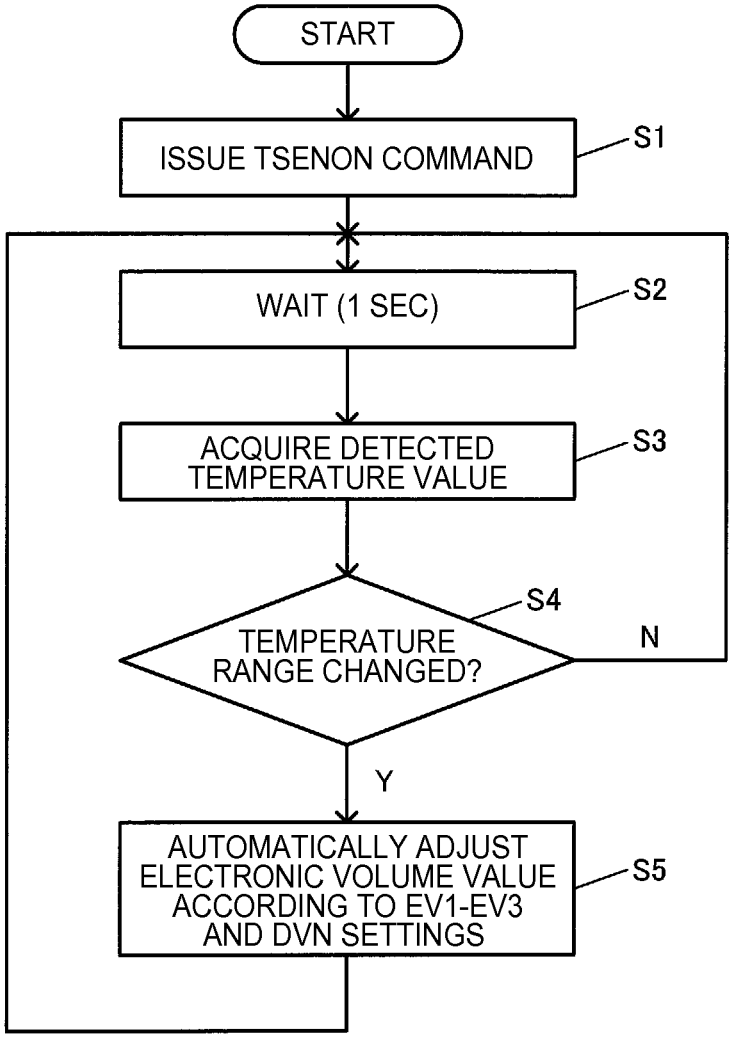
FIG. 11 is a flowchart illustrating operations in the case of automatically adjusting the electronic volume value.
Figure 12:
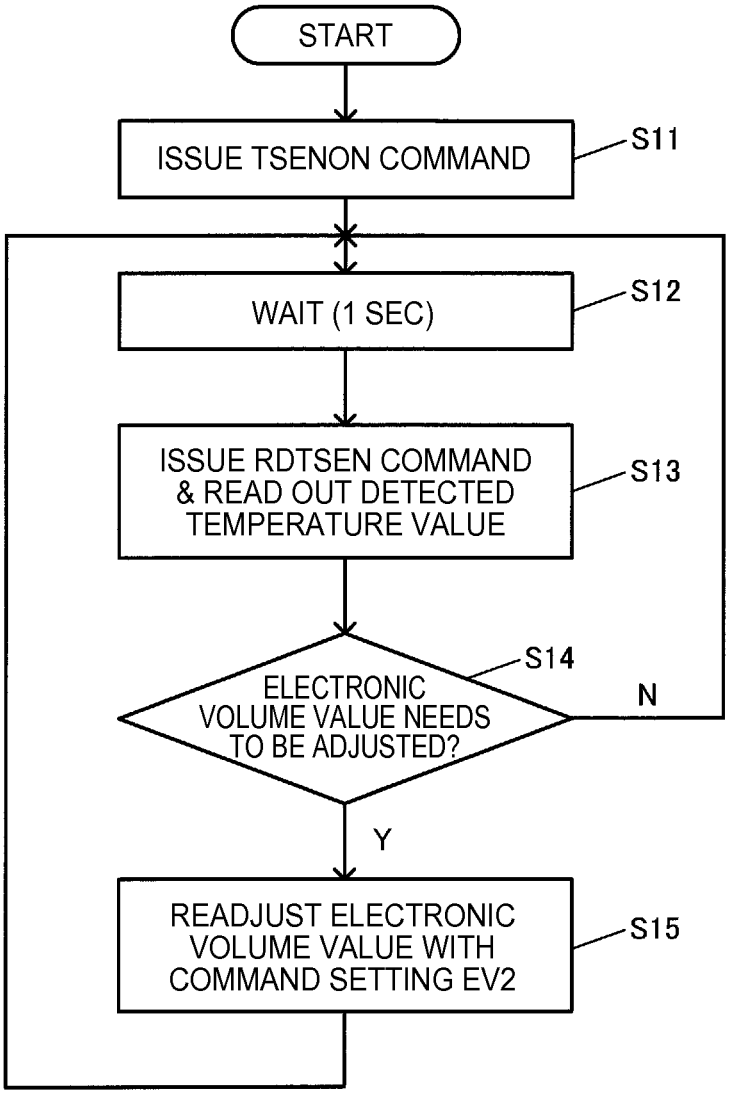
FIG. 12 is a flowchart illustrating operations in the case of not automatically adjusting the electronic volume value.

The selector 32 selects and outputs EVCAL from the adder 30 to the power supply circuit 60 as the electronic volume value EVOL, in the case where automatic adjustment of electronic volume values is set to enabled (FIG. 11 discussed later). On the other hand, the selector 32 outputs the electronic volume value EV2 from the volume value register 42 to the power supply circuit 60 as the electronic volume values EVOL, in the case where automatic adjustment of the electronic volume value is set to disabled (FIG. 12 discussed below).

The display driver of the present embodiment as described above includes the volume value register 42 for variably setting the electronic volume values EV1 to EV3 (broadly, the first to third electronic volume values), the boundary temperature register 44 for variably setting the boundary temperature values TBL and TBH, and the division number register 46 for variably setting the division number DVN.

The temperature range determination unit 24 of the adjustment unit 20 then determines the temperature range to which the detected temperature belongs, based on the boundary temperature values TBL and TBH set in the boundary temperature register 44. Also, the operation unit 28 of the output unit 26 outputs the count value signal CNT for the switching period of electronic volume values and the change amount signal MV of electronic volume values in the switching period, based on the results (FLCUR1 to FLCUR3) and (FLBFR1 to FLBFR3) of the determination by the temperature range determination unit 24 in the current period and in the last period, respectively, and the division number DVN that is set in the division number register 46. The adder 30 of the output unit 26 then performs addition processing, based on the electronic volume values EV1 to EV3 that are set in the volume value register 42, and the count value signal CNT and the change amount signal MV from the operation unit 28. The adder 30 then outputs a plurality of interpolated electronic volume values EVCAL interpolated between the electronic volume values EV1 and EV2 (or EV2 and EV3) with the division number DVN, in the switching period.

Figure 6:
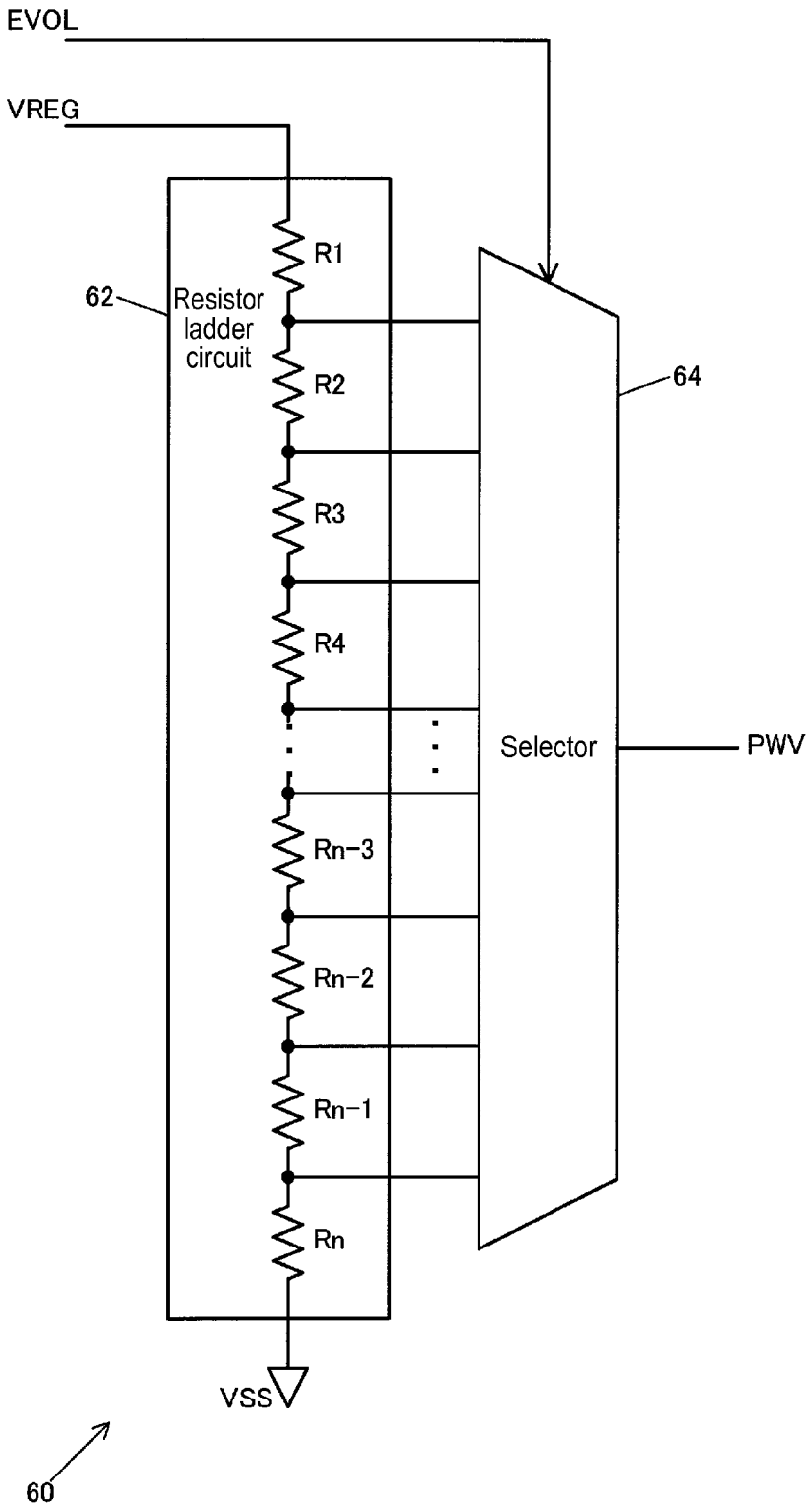
FIG. 6 shows an exemplary configuration of a power supply circuit.

FIG. 6 shows an exemplary configuration of the power supply circuit 60. Note that, in FIG. 6, only the circuit portion of the power supply circuit 60 relating to electronic volume values is shown, and description of other circuit portions (e.g., booster circuit, regulator, etc.) is omitted.

A resistance ladder circuit 62 and a selector 64 are provided in the power supply circuit 60. The resistance ladder circuit 62 has a plurality of resistors R1 to Rn connected in series between a node of a reference power supply voltage VREG (e.g., 3.5V) and a node of the low potential side power supply VSS. The resistance ladder circuit 62 then outputs division voltages obtained by the resistors to tap nodes of the resistors R1 to Rn.

The selector 64 outputs a voltage selected using the electronic volume value EVOL from among a plurality of division voltages from the resistance ladder circuit 62 as the drive power supply voltage PWV. For example, assume that the electronic volume value EVOL is a value instructing to output the drive power supply voltage PWV having a high potential. In this case, the selector 64 selects a division voltage on the high potential side corresponding to the electronic volume values EVOL from among the plurality of division voltages from the resistance ladder circuit 62, and outputs the division voltage as the drive power supply voltage PWV. On the other hand, assume that the electronic volume value EVOL is a value instructing to output the drive power supply voltage PWV of low potential. In this case, the selector selects a division voltage on the low potential side corresponding to the electronic volume values EVOL, from among the plurality of division voltages from the resistance ladder circuit 62, and outputs the selected potential as the drive power supply voltage PWV.

4. Detailed Operations

Figure 7:
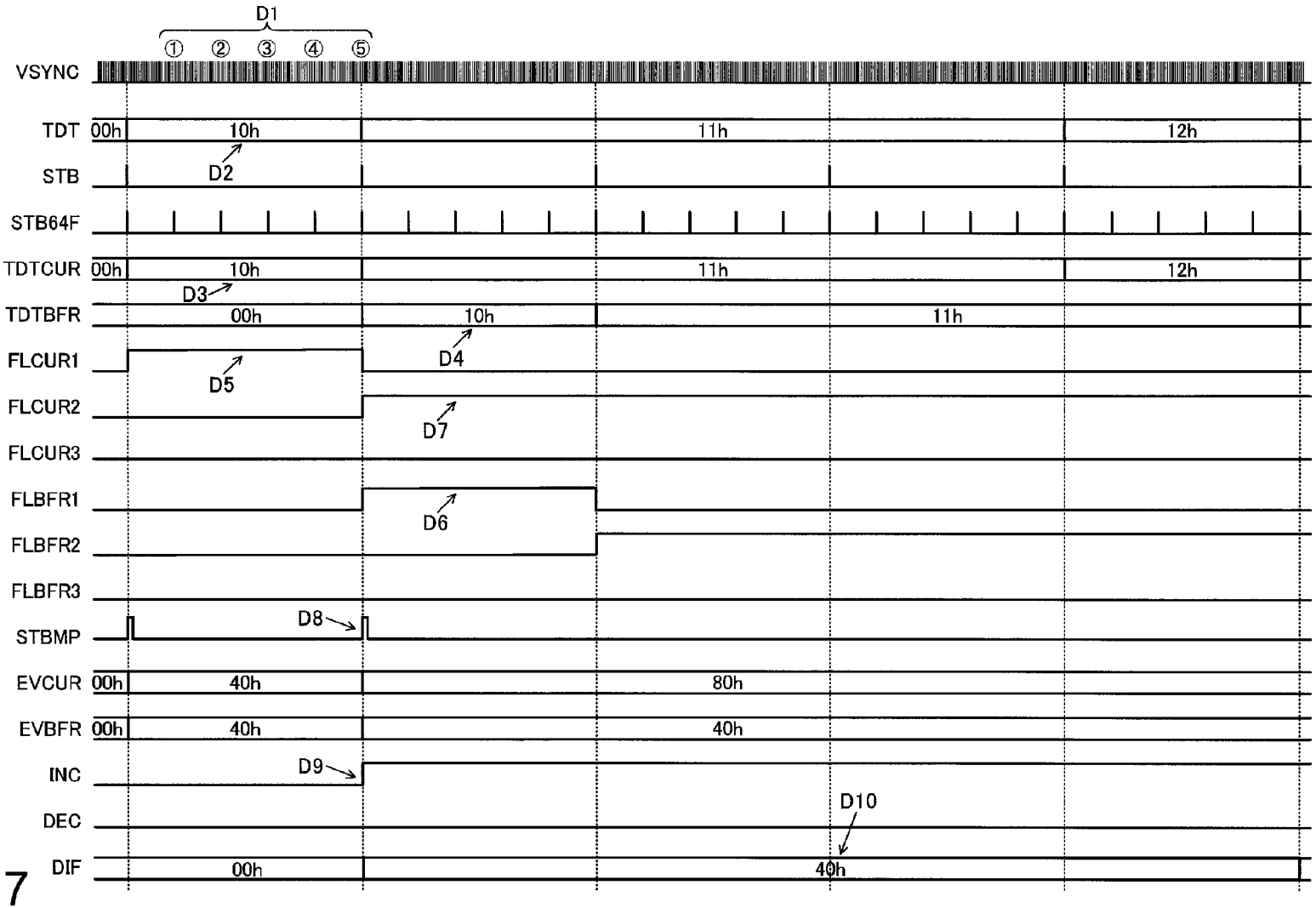
FIG. 7 is a timing chart illustrating operations of the embodiment.

Next, the operations of the present embodiment will be described in detail. FIG. 7 is a timing chart illustrating operations of the present embodiment in detail.

The period shown in D1 of FIG. 7 is a sampling period, and, in the present embodiment, five detected temperature values TAD from the temperature sensor 90 are sampled and latched by the latch unit 22 of FIG. 5. The detected temperature TDT for the sampling period is then derived, based on these five detected temperature values TAD. Specifically, the median of the five detected temperature values TAD is derived as the detected temperature TDT.

In D2, the detected temperature TDT of the current sampling period is determined to be 10h. The latch unit 22 thus outputs TDTCUR=10h to the temperature range determination unit 24 as a signal showing the detected temperature of the current sampling period, as shown in D3. Note that, in the next sampling period, the latch unit 22 will output TDTBFR=10h as a signal showing the detected temperature of the previous sampling period, as shown in D4.

The temperature range determination unit 24, having received the signals TDTCUR and TDTBFR, determines the temperature range to which the detected temperature belongs. The temperature range determination unit 24 then outputs the flag signals FLCUR1 to FLCUR3 and FLBFR1 to FLBFR3 showing the temperature range to which the detected temperature belongs to the operation unit 28 of the output unit 26. Here, FLCUR1, FLCUR2 and FLCUR3 are flag signals respectively showing that the detected temperature of the current sampling period (hereinafter, "the current sampling period" will be referred to simply as "the current" as appropriate) belongs to the low temperature range, the room temperature range and the high temperature range shown in FIG. 3. Also, FLBFR1, FLBFR2 and FLBFR3 are flag signals respectively showing that the detected temperature of the previous sampling period (hereinafter, "the previous sampling period" will be referred to as "the previous" as appropriate) belongs to the low temperature range, the room temperature range and the high temperature range shown in FIG. 3.

For example, it is determined that the current detected temperature TDT=10h belongs in the low temperature range, and, at D5, the flag signal FLCUR1 corresponding to the low temperature range is active (H level). In this case, in the next sampling period, the flag signal FLBFR1 is activated, as shown in D6. Also, since the temperature range switches from the low temperature range to the room temperature range in FIG. 7 as will be discussed later, in the next sampling period, the flag signal FLCUR2 corresponding to the room temperature range will be activated as shown in D7.

The strobe signal STBMP is activated in the case where switching of temperature ranges occurs, as shown in D8. This strobe signal STBMP is output to the adder 30.

The signals EVCUR, EVBFR, INC, DEC and DIF shown in FIG. 7 are internal signals of the operation unit 28. EVCUR is a signal showing the current electronic volume value, and EVBFR is a signal showing the previous electronic volume value. INC is a signal instructing to increase the electronic volume value in the switching period of temperature ranges, and DEC is a signal instructing to decrease the electronic volume value. DIF is a signal showing the difference value between the electronic volume value (EV2) after switching of temperature ranges and the electronic volume value (EV1) before switching of temperature ranges.

In FIG. 7, since the detected temperature TDT changes from 10h to 11h, it is determined that the temperature range to which the detected temperature TDT belongs has switched from the low temperature range to the room temperature range. The strobe signal STBMP is thereby activated, as shown in D8. Also, the signal INC is activated as shown in D9, and increasing the electronic volume value in the switching period is instructed. Also, the difference value is set to DIF=EV2−EV1=80h−40h=40h, as shown in D10.

Figures 8A, 8B, 8C:
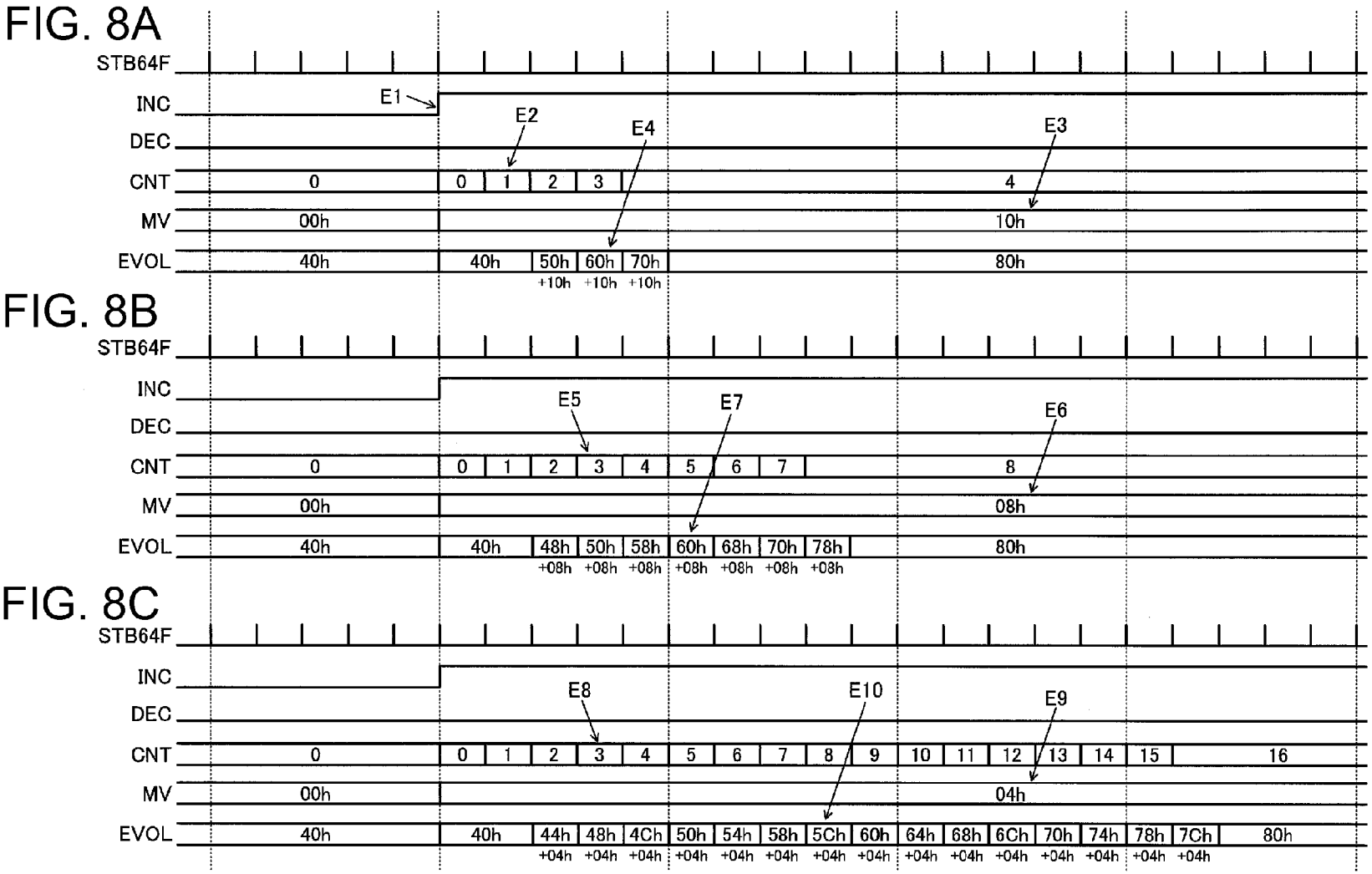
FIG. 8A to FIG. 8C are also timing charts illustrating operations of the embodiment.

FIG. 8A is a timing chart when the division number of the switching period is DVN=4, in the case where the temperature range to which the detected temperature belongs switches from the low temperature range to the room temperature range as shown in FIG. 7. In this case, since the electronic volume value EVOL will increase in the switching period, the signal INC is activated as shown in E1 of FIG. 8A. The operation unit 28 then outputs the count value signal CNT that is incremented from 0 to DVN=4, and the change amount signal MV of the electronic volume values EVOL as (EV2−EV1)/DVN=(80h−40h)/4=10h, as shown in E2 and E3. That is, the change amount of the electronic volume values EVOL is variably set using the division number DVN. Electronic volume values EVOL that gradually increase, such as from 40h to 50h, 60h, 70h and 80h, are then output, as shown in E4. In this case, 50h, 60h and 70h correspond to a plurality of interpolated electronic volume values that are output in the switching period.

FIG. 8B is a timing chart when the division number in the switching period is DVN=8, in the case where the temperature range to which the detected temperature belongs switches from the low temperature range to the room temperature range. In this case, the operation unit 28 outputs the count value signal CNT that is incremented from 0 to DVN=8, and the change amount signal MV of the electronic volume values EVOL as (EV2−EV1)/DVN=(80h−40h)/8=08h, as shown in E5 and E6. Electronic volume values EVOL that gradually increase, such as from 40h to 48h, 50h, 58h, 60h, 68h, 70h, 78h and 80h, will thereby be output as shown in E7. In this case, 48h, 50h, 58h, 60h, 68h, 70h and 78h correspond to a plurality of interpolated electronic volume values that are output in the switching period.

FIG. 8C is a timing chart when the division number in the switching period is DVN=16, in the case where the temperature range to which the detected temperature belongs switches from the low temperature range to the room temperature range. In this case, the operation unit 28 outputs the count value signal CNT that is incremented from 0 to DVN=16, and the change amount signal MV of the electronic volume values EVOL as (EV2−EV1)/DVN=(80h−40h)/16=04h, as shown in E8 and E9. Electronic volume values EVOL that gradually increase, such as from 40h to 4h, 48h, 4Ch, . . . , 74h, 78h, 7Ch and 80h, will be output, as shown in E10.

Figure 9:
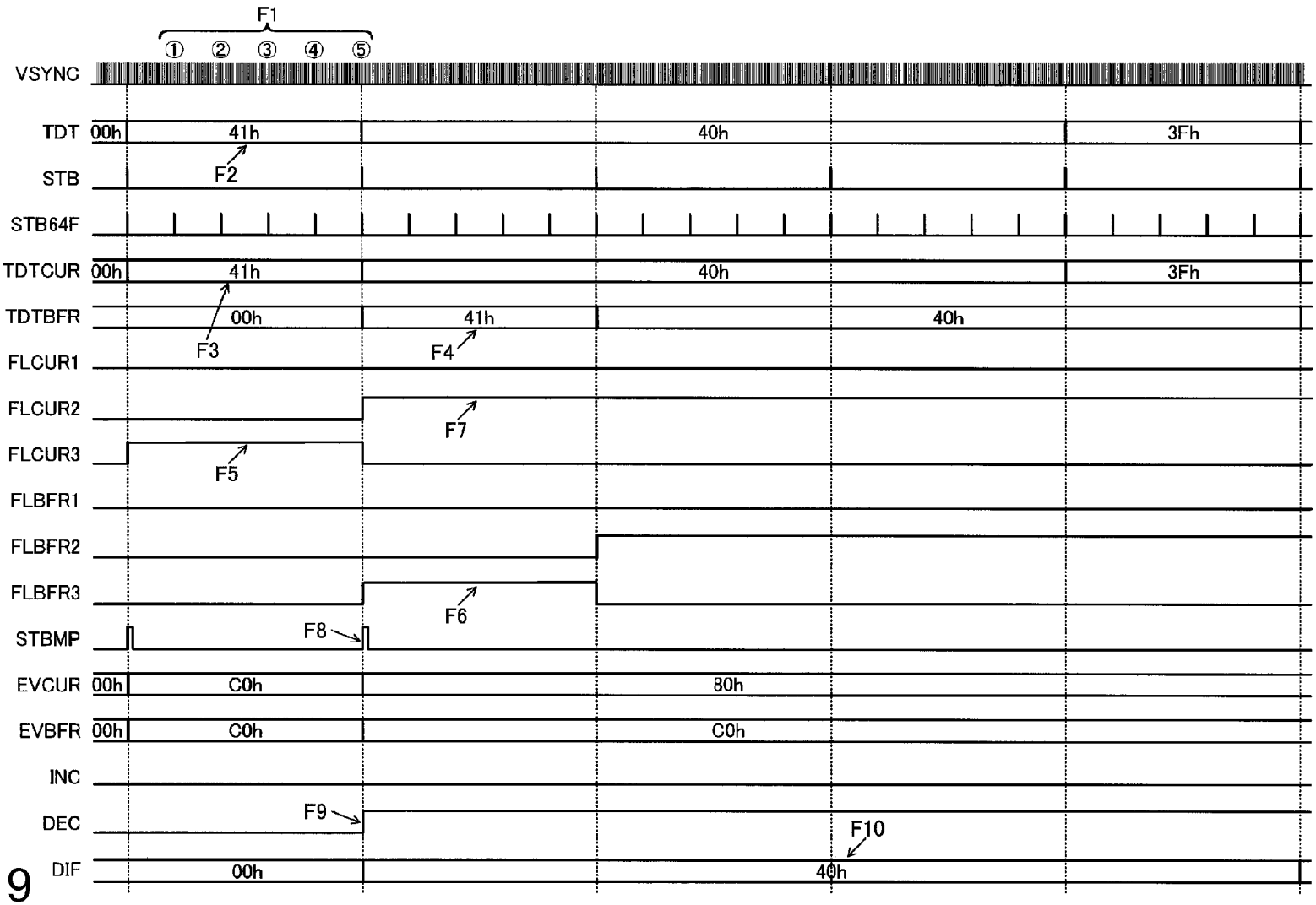
FIG. 9 is a timing chart illustrating operations of the embodiment.

FIG. 9 is also a timing chart illustrating operations of the present embodiment in detail. Whereas above-mentioned FIG. 7 is a timing chart in the case where the temperature range to which the detected temperature belongs switches from the low temperature range to the room temperature range, FIG. 9 is a timing chart in the case where the temperature range to which the detected temperature belongs switches from the high temperature range to the room temperature range.

F1 to F10 in FIG. 9 correspond to D1 to D10 in FIG. 7, and a detailed description thereof is omitted. For example, it is determined that the current detected temperature TDT=41h shown in F2 of FIG. 9 belongs to the high temperature range, and the flag signal FLCUR3 corresponding to the high temperature range is active in F5. In the next sampling period, the flag signal FLBFR3 is activated, as shown in F6. Also, since the temperature range switches from the high temperature range to the room temperature range, the flag signal FLCUR2 corresponding to the room temperature range is activated in the next sampling period, as shown in F7. Also, the signal DEC is activated as shown in F9, and an instruction is issued to reduce the electronic volume values in the switching period. Also, as shown in F10, the difference value is set to DIF=EV3−EV2=C0h−80h=40h.

Figures 10A, 10B, 10C:
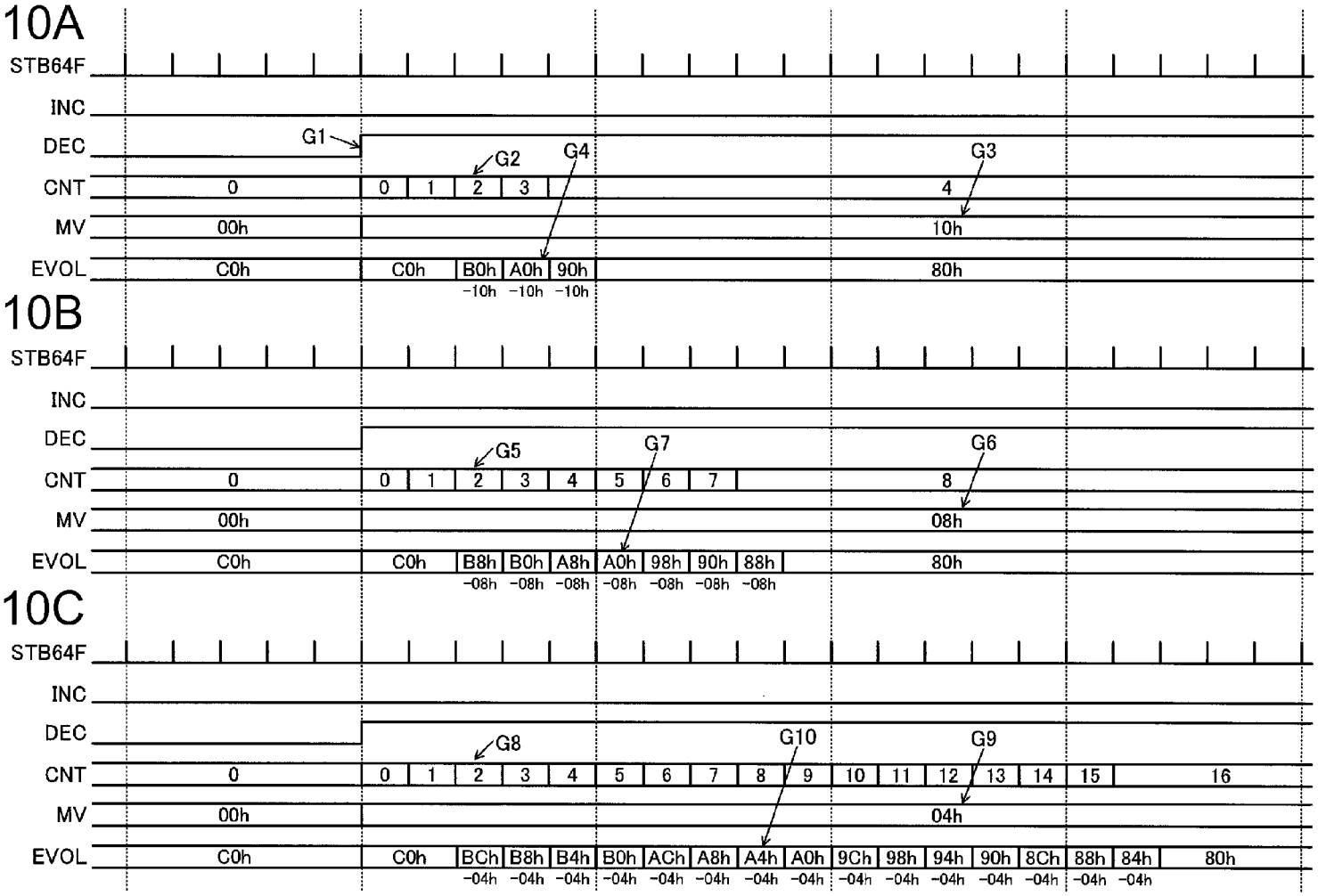
FIG. 10A to FIG. 10C are also timing charts illustrating operations of the embodiment.

FIG. 10A, FIG. 10B, and FIG. 10C are timing charts when the division numbers of the switching period are respectively DVN=4, and 8 and 16, in the case where the temperature range to which the detected temperature belongs switches from the high temperature range to the room temperature range as shown in FIG. 9.

In FIG. 10A, the signal DEC is activated as shown in G1, and the count value signal CNT that changes from 0 to DVN=4 and the change amount signal MV=10 are output, as shown in G2 and G3. Electronic volume values EVOL that gradually decrease, such as from C0h to B0h, A0h, 90h and 80h, will be output, as shown in G4.

In FIG. 10B, the count value signal CNT that changes from 0 to DVN=8, and the change amount signal MV=08h are output, as shown in G5 and G6. Electronic volume values EVOL that gradually decrease, such as from C0h to B8h, B0h, A8h, A0h, 98h, 90h, 88h and 80h, will be output as shown in G7.

In FIG. 10C, the count value signal CNT that changes from 0 to DVN=16, and the change amount signal MV=04h are output, as shown in G8 and G9. Electronic volume values EVOL that gradually decrease, such as from C0h to BCh, B8h, B4h, . . . , 90h, 8Ch, 88h, 84h and 80h, will thereby be output as shown in G10.

FIG. 11 is a flowchart illustrating operations of the present embodiment in the case of automatically adjusting the electronic volume values.

First, an external device, for example, issues a TSENON command that turns on temperature detection by the temperature sensor 90 (step S1). This TSENON command is accepted by the I/F unit 120, and decoded by the decoding unit 50. The adjustment unit 20 waits for 1 second, for example (step S2), and then acquires a detected temperature value from the temperature sensor 90 (step S3). It is then determined whether the temperature range to which the detected temperature belongs has transitioned (step S4). For example, it is determined whether the temperature range to which the detected temperature belongs has transitioned from the low temperature range to the room temperature range, from the room temperature range to the high temperature range, from the high temperature range to the room temperature range, or from the room temperature range to the low temperature range. In the case where the temperature range has not transitioned, the processing returns to step S2. On the other hand, in the case where the temperature range has transitioned, the adjustment unit 20 executes automatic adjustment of the electronic volume values, according to the settings of the electronic volume values EV1 to EV3, the division number DVN, and the like (step S5). That is, processing for automatically adjusting the electronic volume values described in FIGS. 7 to 10C and the like is executed.

FIG. 12 is a flowchart illustrating operations of the present embodiment in the case of adjusting the electronic volume values automatically.

First, an external device, for example, issues a TSENON command (step S11). Next, the external device waits for 1 second, for example (step S12), and then issues a RDTSEN command which is a command for reading out the detected temperature value, and reads the detected temperature value of the temperature sensor 90 (step S13). The TSENON command and the RDTSEN command are accepted by the I/F unit 120, and decoded by the decoding unit 50. The detected temperature value of the temperature sensor 90 is then read out by the external device via the I/F unit 120. Next, the external device determines whether the electronic volume value needs to be adjusted based on the read detected temperature value (step S14) and the processing returns to step S12 in the case where it is determined that adjustment is not required. On the other hand, in the case where it is determined that adjustment is required, the external device readjusts the electronic volume value with a command that sets the electronic volume value EV2 (step S15). That is, in this case, the selector 32 of FIG. 5 selects the electronic volume value EV2 from the volume value register 42. Readjustment of the electronic volume value is executed by the external device setting a desired electronic volume value as EV2.

Figures 13A, 13B:
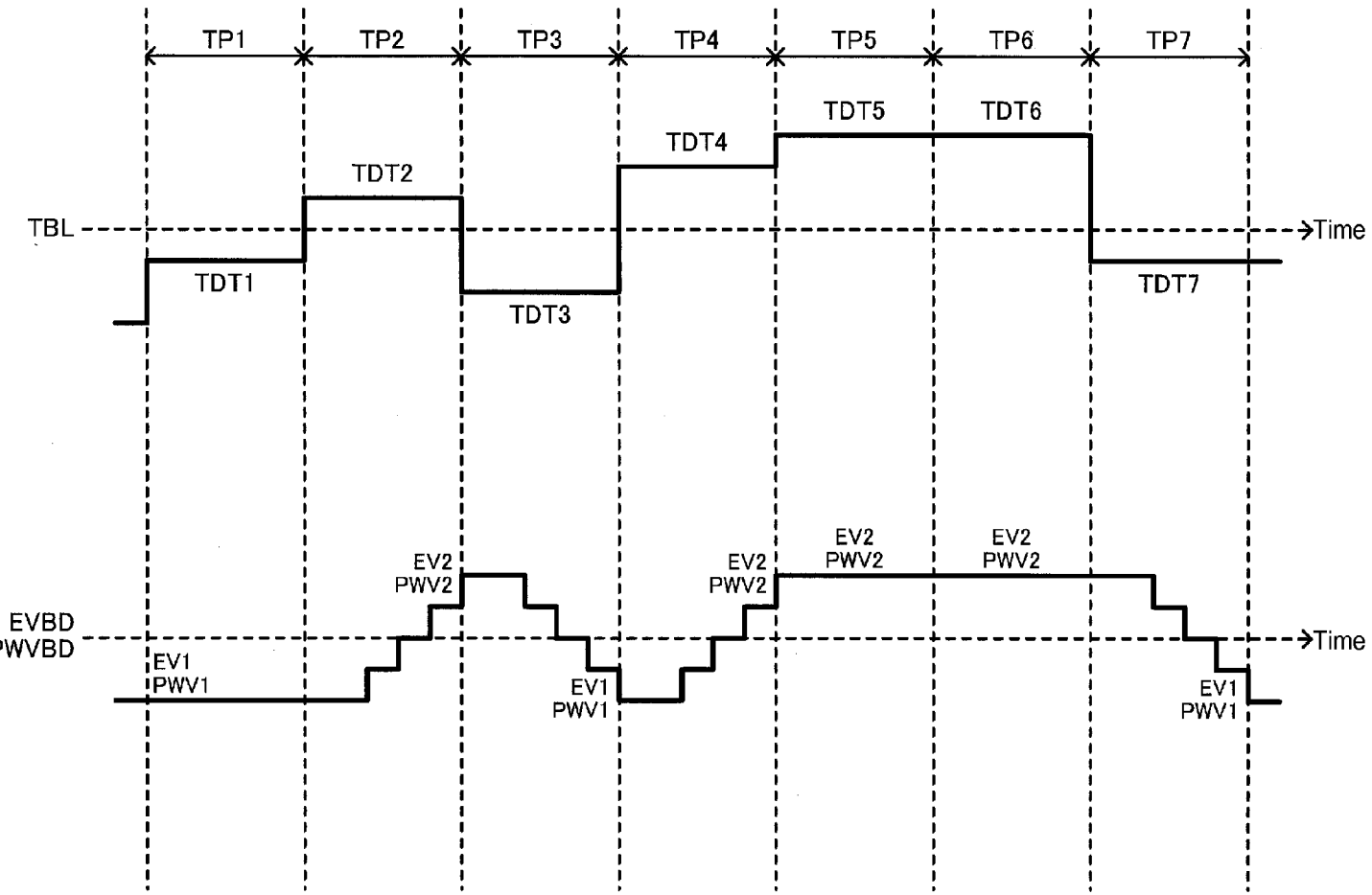
FIG. 13A and FIG. 13B illustrate a technique for adjusting the electronic volume value and the drive power supply voltage of the embodiment.

FIG. 13A and FIG. 13B are diagrams illustrating a technique for adjusting the electronic volume value and the drive power supply voltage of the present embodiment.

In FIG. 13A, TBL is the boundary temperature value of the low temperature range and the high temperature range, and switching of the electronic volume value is performed with this boundary temperature value TBL as the boundary. In FIG. 13A, the detected temperature transitions up and down near this boundary temperature value TBL.

For example, in a period TP1 (sampling period), five detected temperature values TAD from the temperature sensor 90 are sampled, and the median of the five detected temperature values TAD is derived as a detected temperature TDT1. Similarly, in periods TP2, TP3, TP4, TP5, TP6 and TP7, the median of five detected temperature values TAD in each period is derived as detected temperatures TDT2, TDT3, TDT4, TDT5, TDT6 and TDT7.

The detected temperature TDT1 of the period TP1 is lower than the boundary temperature value TBL, and the detected temperature TDT2 of the next period TP2 is higher than the boundary temperature value TBL. Also, the detected temperature TDT3 of the period TP3 is lower than the boundary temperature value TBL, and the detected temperature TDT4 of the next period TP4 is higher than the boundary temperature value TBL. Also, the detected temperature TDT5 and TDT6 of the periods TP5 and TP6 are higher than the boundary temperature value TBL, and the detected temperature TDT7 of the next period TP77 is lower than the boundary temperature value TBL. Thus, in FIG. 13A, the detected temperature transitions up and down near the boundary temperature value TBL.

When the technique of the present embodiment is not employed in the case where the detected temperature fluctuates unstably near the boundary temperature value TBL (or TBH), the electronic volume value switches frequently, causing the drive power supply voltage to switch frequently, which in turn results in flicker occurring in the image display. For example, in FIG. 3, the electronic volume value EV1=40h is set with respect to the low temperature range, and the electronic volume value EV2=80h is set with respect to the room temperature range. Accordingly, when the detected temperature fluctuates unstably near the boundary temperature value TBL as shown in FIG. 13A, the electronic volume value switches at one time from EV1=40h to EV2=80h and from EV2=80h to EV1=40h. The drive power supply voltage thereby changes greatly, and flicker on the display occurs.

With regard to this point, by employing the technique of the present embodiment, the electronic volume values will increase or decrease gradually, and the drive power supply voltage will also increase or decrease gradually, in the switching period of electronic volume values, as shown in FIG. 13B.

For example, the detected temperature TDT1 of the period TP1 belongs in the low temperature range, and the detected temperature TDT2 of the period T2 belongs to the room temperature range. Accordingly, when transitioning from the period TP1 to TP2, it is determined that the temperature range has switched, and the electronic volume values and the drive power supply voltages that respectively increase gradually from EV1 and PWV1 to EV2 and PWV2, as shown in FIG. 13B. Here, EV1 and EV2 (first and second electronic volume values) are respectively the electronic volume values set in the low temperature range and the room temperature range. Also, PWV1 and PWV2 (first and second voltages) are respectively the drive power supply voltages that are used when the electronic volume values are set to EV1 and EV2. Also, EVBD and PWVBD are boundary values, such as EVBD=(EV1+EV2)/2, and PWVBD=(PWV1+PWV2)/2, for example.

Also, the detected temperature TDT2 of the period TP2 belongs to the room temperature range, and the detected temperature TDT3 of the period TP3 belongs in the low temperature range. Accordingly, when transitioning from the period TP2 to TP3, it is determined that the temperature range has switched, and the electronic volume value and the drive power supply voltage respectively decrease gradually from EV2 and PWV2 to EV1 and PWV1.

Also, the detected temperature TDT3 of the period TP3 belongs in the low temperature range, and the detected temperature TDT4 of period TP4 belongs to the room temperature range. Accordingly, when transitioning from the period TP3 to TP4, it is determined that the temperature range has switched, and the electronic volume value and the drive power supply voltage respectively increase gradually from EV1 and PWV1 to EV2 and PWV2.

Also, the detected temperatures TDT4, TDT5 and TDT6 of the periods TP4, TP5 and TP6 all belong to the room temperature range. Accordingly, in the case of transitioning from the period TP4 to TP5 or from period TP5 to TP6, it is determined that the temperature range has not switched, and the electronic volume value and the drive power supply voltage remain constant without changing from EV2 and PWV2. When transitioning from the period TP6 to the period TP7, it is determined that the temperature range has switched and the electronic volume value and the drive power supply voltage respectively decrease gradually from EV2 and PWV2 to EV1 and PWV1.

That is, in FIG. 13A, the detected temperature TDT1 (first detected temperature) derived based on five detected temperature values TAD (plurality of first detected temperature values) that are output from the temperature sensor 90 in the period TP1 (first period) belongs in the low temperature range (first temperature range). Also, the detected temperature TDT2 (second detected temperature) derived based on five detected temperature values TAD (plurality of second detected temperature values) that are output from the temperature sensor 90 in the period TP2 (second period) belongs to the room temperature range (second temperature range).

In the present embodiment in this case, when it is determined, after transitioning from the period TP1 to TP2, that the temperature range to which the detected temperature belongs has switched from the low temperature range to the room temperature range, the adjustment unit 20, in the switching period, outputs a plurality of interpolated electronic volume values obtained by interpolating electronic volumes EV1 and EV2. The power supply circuit 60, having received these interpolated electronic volume values, supplies a plurality of interpolated voltages obtained by interpolating the voltage PWV1 (first voltage) and the voltage PWV2 (second voltage) as the drive power supply voltages.

In the present embodiment as described above, the electronic volume values and drive power supply voltages will gradually increase or decrease in a switching period of temperature ranges, even in the case where the detected temperature changes unstably near the boundary temperature value TBL. Accordingly, display flicker can be sufficiently suppressed. Also, similarly to the periods TP5 and TP6, while the detected temperature belongs to the same group, the electronic volume value does not change from the same value, and the detected temperature belongs to one temperature range, and the drive power supply voltage also remains constant without changing from the same voltage. Accordingly, a situation where the hue or the like of image display changes unnecessarily due to a change in the drive power supply voltage caused by the electronic volume value changing unnecessarily in the case where there is little temperature fluctuation can be suppressed.

5. Electronic Device

Figure 14:
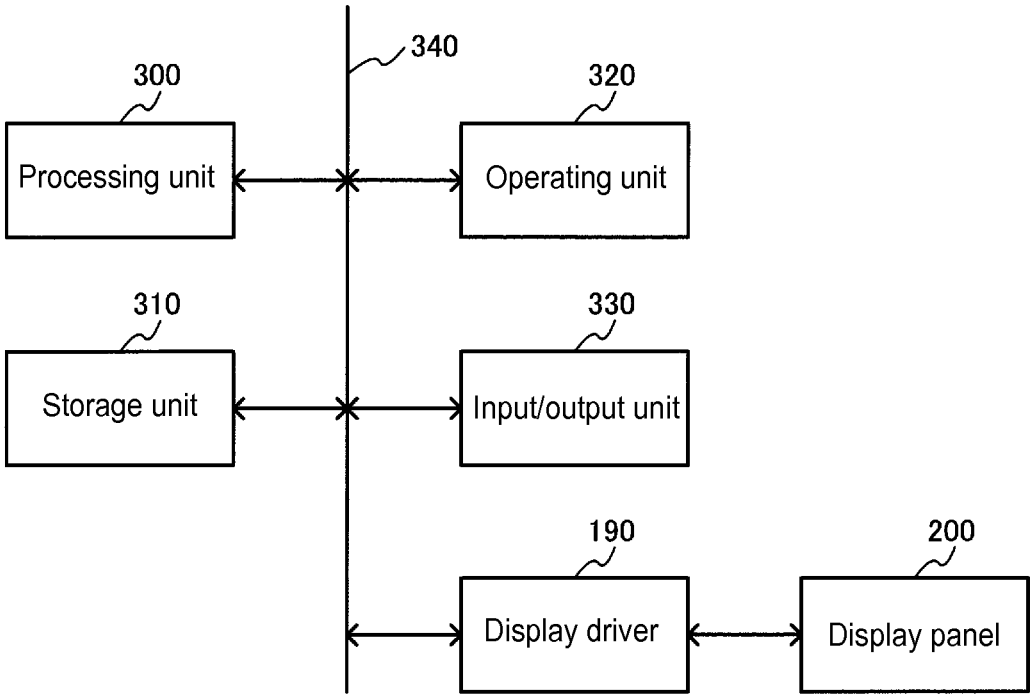
FIG. 14 shows an exemplary configuration of an electronic device of the embodiment.

FIG. 14 shows an exemplary configuration of an electronic device that includes the display driver 190 of the present embodiment. The electronic device includes a processing unit 300, a storage unit 310, an operating unit 320, an input/output unit 330, a display driver 190, and a display panel 200. An electro-optical device is constituted by the display driver 190 and the display panel 200. Note that the electronic device of the present embodiment is not limited to the configuration shown in FIG. 14, and various modifications such as omitting some of the constituent elements or adding other constituent elements are possible. Also, it is envisioned that the present embodiment is applicable to various electronic devices, such as in-vehicle devices (driver assistance devices, instrument panel units, car navigation devices, etc.), handheld terminals (smartphones, mobile phones, etc.), projectors, digital cameras, video cameras, printers, electronic notebooks, electronic dictionaries, televisions, HMDs and information processing devices (PCs, PDAs).

The processing unit 300 performs various types of control processing and operation processing of the electronic device, and is realized by a processor such as MPU, an ASIC such as a display controller, and the like. The image display operation of the display panel 200 is realized by the processing unit 300 issuing various types of commands to the display driver 190.

The storage unit 310 serves as a storage area of processing unit 300 or the like, and is realized by DRAM, SRAM, HDD or the like. For example, the data of images that are displayed on the display panel 200 is stored in the storage unit 310. The operating unit 320 is for a user to input various types of operation information. The input/output unit 330 transmits and receives data with an external device, and is realized by a wired interface (USB, etc.), a wireless communication unit, or the like.

Note that although the present embodiment has been described in detail above, a person skilled in the art will appreciate that numerous modifications can be made without substantially departing from the novel matter and effects of the invention. Accordingly, all such modifications are within the scope of the invention. For example, terms (low temperature range, room temperature range, high temperature range, etc.) that appear in the description or drawings at least once together with other broader or synonymous terms (first, second and third temperature ranges, etc.) can be replaced by those other terms at any place within the description or drawings. Also, the configurations and operations of the display driver, the electro-optical device, the electronic device and the like are not limited to those described in the present embodiment, and various modifications can be made.

The entire disclosure of Japanese Patent Application No. 2014-054799, filed Mar. 18, 2014 is expressly incorporated by reference herein.

What is claimed is:

1. A display driver comprising:

an adjustment unit that outputs an electronic volume value based on a detected temperature derived using a temperature sensor;

a power supply circuit that supplies a drive power supply voltage based on the electronic volume value; and a drive circuit that drives a display panel based on the drive power supply voltage, wherein the adjustment unit:

in response to determining that the detected temperature belongs to a first temperature range, outputs a first non-interpolated electronic volume value that sets the drive power supply voltage to a first voltage, in response to determining that the detected temperature belongs to a second temperature range, outputs a second non-interpolated electronic volume value that sets the drive power supply voltage to a second voltage, and in response to determining that a temperature range to which the detected temperature belongs switches from the first temperature range to the second temperature range, outputs an interpolated electronic volume value that sets the drive power supply voltage to an interpolated voltage that is between the first voltage and the second voltage.

2. The display driver according to claim 1, wherein the adjustment unit, in response to determining that the temperature range to which the detected temperature belongs switches from the first temperature range to the second temperature range, outputs a plurality of interpolated electronic volume values interpolated between the first electronic volume value and the second electronic volume value based on a given division number.

3. The display driver according to claim 2, comprising a division number register for variably setting the given division number.

4. The display driver according to claim 1, wherein the adjustment unit includes:

a temperature range determination unit that determines the temperature range to which the detected temperature belongs; and an output unit that determines whether the temperature range to which the detected temperature belongs has changed, based on a result of the determination by the temperature range determination unit in a current period and in a last period, and in response to determining that the temperature range has changed, outputs the interpolated electronic volume value that is between the first electronic volume value and the second electronic volume value.

5. The display driver according to claim 1, wherein the adjustment unit derives the detected temperature, based on a plurality of detected temperature values from the temperature sensor, and determines the temperature range to which the detected temperature belongs based on the plurality of detected temperature values.

6. The display driver according to claim 5, wherein $T1 \geq T2$, where T1 is a length of a period in which the plurality of detected temperature values are output from the temperature sensor, and T2 is a length of a period in which the interpolated electronic volume value is output.

7. The display driver according to claim 1, further comprising a volume value register for variably setting the first single electronic volume value and the second single electronic volume value.

8. The display driver according to claim 1, further comprising a boundary temperature register for variably setting a boundary temperature value of the first temperature range and the second temperature range.

9. The display driver according to claim 1, further comprising:

a volume value register for variably setting the first single electronic volume value and the second single electronic volume value;

a boundary temperature register for variably setting a boundary temperature value of the first temperature range and the second temperature range; and a division number register for variably setting the division number, wherein the adjustment unit includes:

a temperature range determination unit that determines the temperature range to which the detected temperature belongs, based on the boundary temperature value that is set in the boundary temperature register;

an operation unit that outputs a count value signal of a switching period of the electronic volume value and a change amount signal of the electronic volume value in the switching period, based on a result of the determination by the temperature range determination unit in a current period and in a last period, and the division number that is set in the division number register; and an adder that performs addition processing, based on the first single electronic volume value and the second single electronic volume value that are set in the volume value register, and the count value signal and the change amount signal from the operation unit, and outputs, in the switching period, a plurality of interpolated electronic volume values interpolated between the first single electronic volume value and the second single electronic volume value with the division number.

10. The display driver according to claim 1, wherein in response to determining that a first detected temperature derived based on a plurality of first detected temperature values that are output from the temperature sensor in a first period belongs to the first temperature range, and a second detected temperature derived based on a plurality of second detected temperature values that are output from the temperature sensor in a second period belongs to the second temperature range, the power supply circuit supplies a plurality of interpolated voltages obtained by interpolating the first voltage and the second voltage as the drive power supply voltage.

11. An electronic device comprising the display driver according to claim 1.

12. A display driver comprising:

a processor that obtains a temperature detected from a temperature sensor;

a power supply circuit that supplies a drive power supply voltage based on an electronic volume value; and a drive circuit that drives a display panel based on the drive power supply voltage, wherein the processor is programmed to:

determine whether a first detected temperature belongs to a first temperature range or a second temperature range, the second temperature range being different than the first temperature range; and output a single electronic volume value that sets the drive power supply voltage as one of:

a first non-interpolated voltage, if the first detected temperature belongs to the first temperature range, and a second non-interpolated voltage, if the first detected temperature belongs to the second temperature range, the second voltage being different than the first voltage, and in response to determining that a temperature range to which the detected temperature belongs switches from the first temperature range to the second temperature range, output an interpolated electronic volume value that sets the drive power supply voltage to an interpolated voltage that is between the first non-interpolated voltage and the second non-interpolated voltage.

13. The display driver according to claim 12, wherein the second temperature range to which the second detected temperature belongs is different than the first temperature range to which the detected first temperature belongs.

14. The display driver according to claim 12, wherein the processor is further programmed to obtain the first detected temperature and the second detected temperature based on a plurality of detected temperature values from the temperature sensor.

15. The display driver according to claim 12, further comprising a volume value register, wherein the processor is further programmed to set the first single electronic volume value and the second single electronic volume value in the volume value register.

16. The display driver according to claim 12, further comprising a boundary temperature register, wherein the processor is further programmed to set a boundary temperature value of the first temperature range and the second temperature range in the boundary temperature register.

17. An electronic device comprising the display driver according to claim 12.

* * * * *